US007125099B2

(12) United States Patent
Murakami et al.

(10) Patent No.: US 7,125,099 B2
(45) Date of Patent: Oct. 24, 2006

(54) LIQUID EJECTOR AND LIQUID EJECTING METHOD

(75) Inventors: Takaaki Murakami, Kanagawa (JP); Yuji Yakura, Kanagawa (JP); Shinji Kayaba, Tokyo (JP); Atsushi Nakamura, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 10/560,334

(22) PCT Filed: Jun. 10, 2004

(86) PCT No.: PCT/JP2004/008497

§ 371 (c)(1),
(2), (4) Date: Apr. 24, 2006

(87) PCT Pub. No.: WO2004/110765

PCT Pub. Date: Dec. 23, 2004

(65) Prior Publication Data

US 2006/0209103 A1 Sep. 21, 2006

(30) Foreign Application Priority Data

Jun. 11, 2003 (JP) ..... 2003-167082

(51) Int. Cl.
*B41J 2/14* (2006.01)

(52) U.S. Cl. ..... 347/48; 347/13; 347/42

(58) Field of Classification Search ..... 347/12–13, 347/40–42, 48, 5, 19, 62
See application file for complete search history.

(56) References Cited

U.S. PATENT DOCUMENTS 5,528,272 A * 6/1996 Quinn et al. ..... 347/42
6,290,335 B1 * 9/2001 Kawai et al. ..... 347/62
6,382,768 B1 * 5/2002 Koitabashi et al. ..... 347/48

FOREIGN PATENT DOCUMENTS

JP 02-195752 12/1990

(Continued)

*Primary Examiner*—Stephen Meier
*Assistant Examiner*—Lam S. Nguyen
(74) *Attorney, Agent, or Firm*—Sonnenschein Nath & Rosenthal LLP

(57) ABSTRACT

A liquid ejecting apparatus can array dots in line even when nozzles are arranged in line and ink droplets are ejected from a plurality of liquid ejecting parts with a time difference. The liquid ejecting apparatus includes a head in which the liquid ejecting parts are arranged in line in the X-direction, and in which a plurality of heating resistors are juxtaposed in the direction perpendicular to the Y-direction in each of the liquid ejecting parts. The liquid ejecting apparatus further includes an ejecting-direction changing means that can change the droplet ejecting direction to a plurality of directions along the Y-direction by applying energy to the juxtaposed heating resistors in different manners, a time-difference ejection means that forms a dot (D2) by a second liquid ejecting part when a predetermined time elapses after a dot (D1) is formed by a first liquid ejecting part, and an ejecting-direction control means that makes the ejecting direction of the droplet from the first liquid ejecting part different from the ejecting direction of the droplet from the second liquid ejecting part so that the distance between the landing position of the dot (D1) in the first liquid ejecting part and the landing position of the dot (D2) in the second liquid ejecting part in the Y-direction is shorter than the relative moving distance between the head and printing paper.

8 Claims, 11 Drawing Sheets

FOREIGN PATENT DOCUMENTS

| | | |
|---|---|---|
| JP | 08-48034 | 2/1996 |
| JP | 09-193393 | 7/1997 |
| JP | 2001-105584 | 4/2001 |
| JP | 2001-347663 | 12/2001 |
| JP | 2002-52708 | 2/2002 |
| JP | 2002-192727 | 7/2002 |
| JP | 2002-240287 | 8/2002 |
| JP | 2003-80696 | 3/2003 |

* cited by examiner

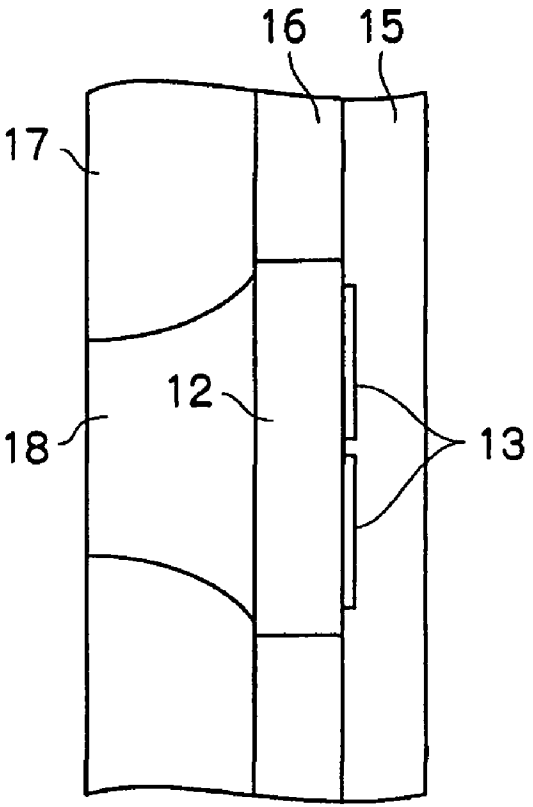
Fig.3
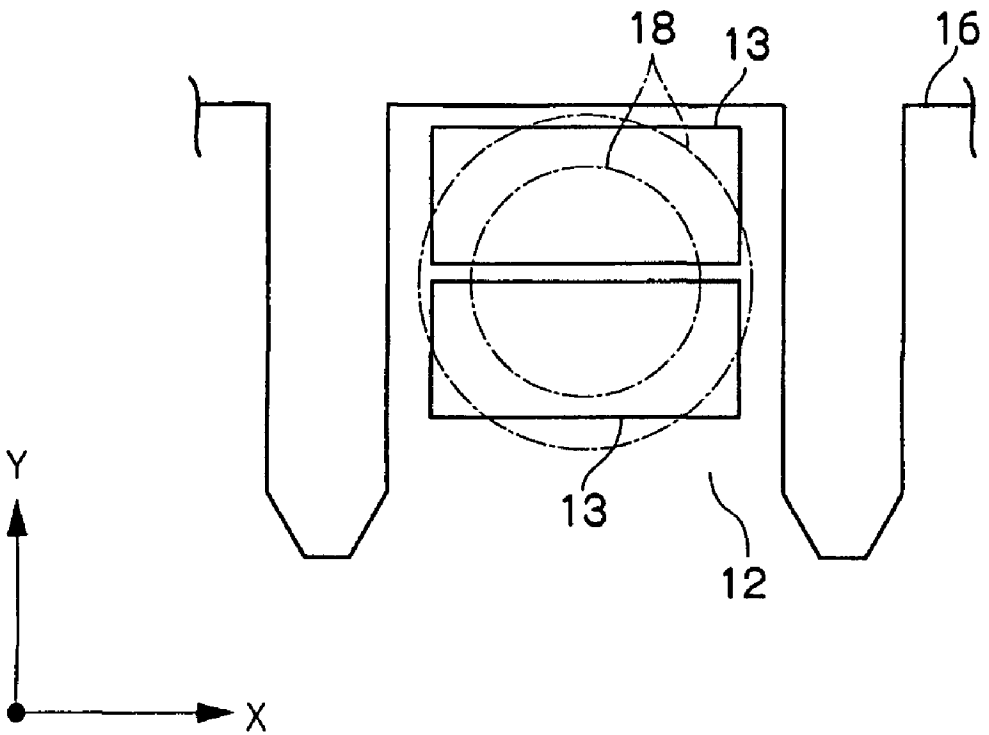

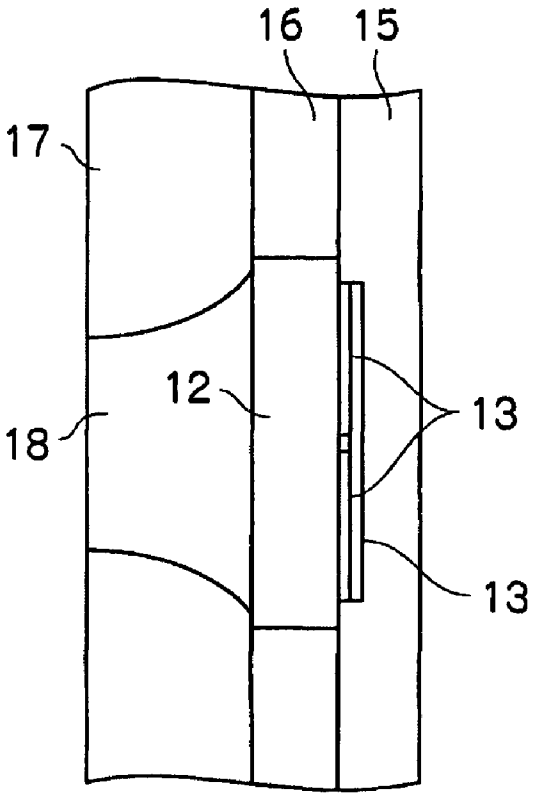
Fig.9
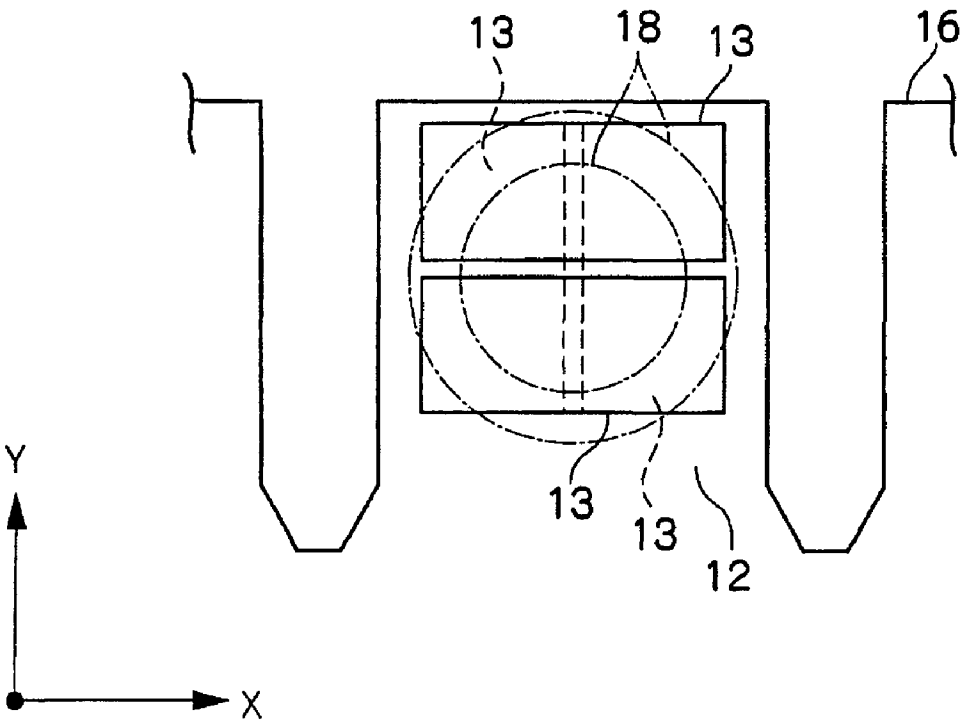

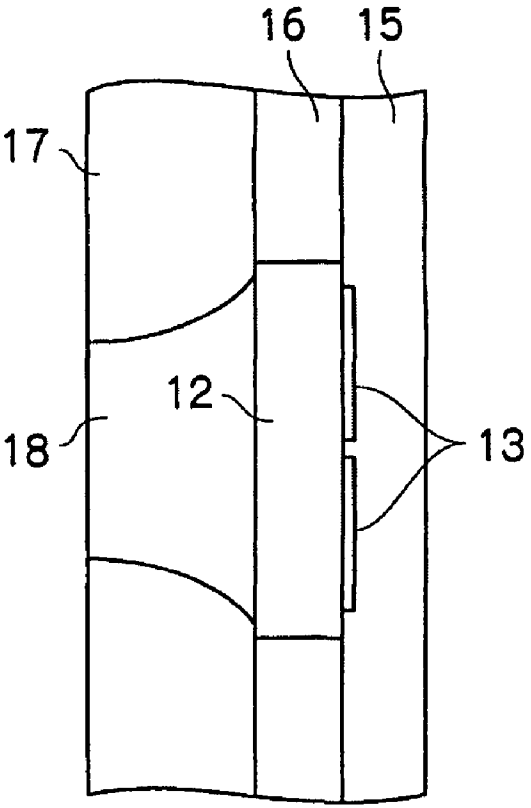
Fig.10
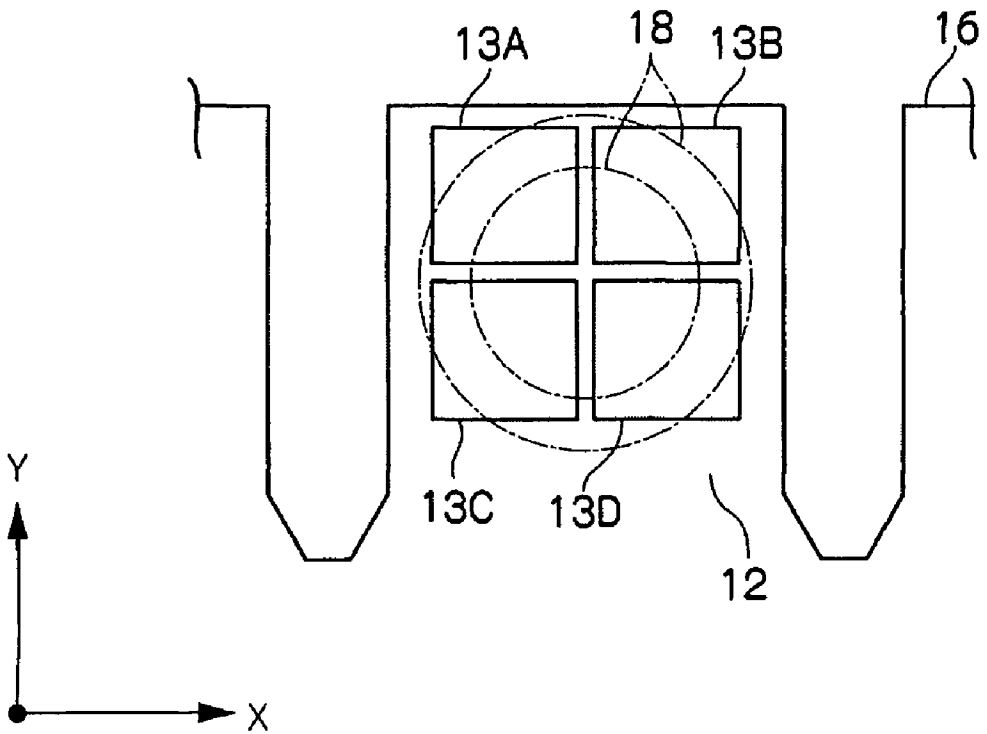

LIQUID EJECTOR AND LIQUID EJECTING METHOD

TECHNICAL FIELD

The present invention relates to a liquid ejecting apparatus which has a head including a plurality of liquid ejecting parts juxtaposed to array nozzles in line and which applies droplets ejected from the nozzles of the liquid ejecting parts onto a droplet landing object that moves relative to the head perpendicularly to the array direction of the nozzles, and to a liquid ejecting method which uses a head including a plurality of liquid ejecting parts having nozzles and juxtaposed to array the nozzles in line and which applies droplets ejected from the nozzles of the liquid ejecting parts onto a droplet landing object that moves relative to the head perpendicularly to the array direction of the nozzles.

More specifically, the present invention relates to a technique that allows droplets ejected from a plurality of nozzles with a time difference to land on the same line even when a head and a droplet landing object move relative to each other during the time difference.

BACKGROUND ART

Inkjet printers are known as liquid ejecting apparatuses of one type. Known inkjet printers include a serial type which applies ink droplets ejected from a head onto printing paper while moving the head in the width direction of the printing paper and which feeds the printing paper perpendicularly to the width direction of the printing paper, and a line type which has a line head extending along the entire width of printing paper, which feeds only the printing paper perpendicularly to the width direction thereof, and which applies ink droplets ejected from the line head onto the printing paper.

The head includes a plurality of nozzles for ejecting ink droplets. In the line type, the nozzles are typically not arrayed in line in the width direction of the printing paper. For example, nozzles are arranged along a line inclined with respect to the feeding direction of printing paper, as is disclosed in Japanese Unexamined Patent Application Publication No. 2002-36522.

More specifically, as shown in FIG. 6 of Japanese Unexamined Patent Application Publication No. 2002-36522, nozzles 31 are not arranged straight perpendicularly to the feeding direction of a sheet 14 (in a direction shown by a one-dot chain line in FIG. 6 of Japanese Unexamined Patent Application Publication No. 2002-36522). The first to seventh nozzles 31 are arranged in a direction declining to the right with respect to the direction shown by the one-dot chain line.

The nozzles are arranged in the above manner for the following reason:

FIG. 11 is a view showing the positional relationship between the arrangement of nozzles 1 to 4 of liquid ejecting parts, and dots formed on printing paper. In FIG. 11, the nozzles 1 to 4 are arranged in line (in a straight line) in a head. This direction is defined as an X-direction, and a direction perpendicular to the X-direction is defined as a Y-direction. Therefore, the printing paper is fed in the Y-direction. In FIG. 11, the head is fixed, and only the printing paper is fed in the Y-direction (downward).

During printing, the printing paper is continuously fed in the Y-direction (downward) in the figure. Simultaneously, ink droplets are ejected from the nozzles 1 to 4 of the liquid ejecting parts, and land on the printing paper.

Ink droplets are ejected from the nozzles 1 to 4 of the liquid ejecting parts at a plurality of different times, and all the liquid ejecting parts are not simultaneously driven to eject ink droplets. Although a plurality of liquid ejecting parts are simultaneously driven, adjoining liquid ejecting parts are not selected as liquid ejecting parts that are simultaneously driven.

Normally, ink droplets are simultaneously ejected from a plurality of liquid ejecting parts. Liquid ejecting parts to be selected in this case are apart from one another to some extent. When an ink droplet is ejected from one liquid ejecting part, vibration caused by the ejection is transmitted to an ink chamber and an ink channel, and has an influence on the adjoining liquid ejecting part.

This influence appears as a change of a meniscus (position of an ink surface in the nozzle). If an ink droplet is ejected in a state in which the meniscus is changed, the size of a landing dot changes. In order to avoid this situation, control is executed so that, when an ink droplet is ejected from one liquid ejecting part, an ink droplet is not ejected from an adjoining liquid ejecting part until the change of the meniscus is removed. As liquid ejecting parts that simultaneously eject ink droplets, liquid ejecting parts disposed at separate positions are selected.

When ink droplets are ejected by simultaneously driving all the liquid ejecting parts, the instantaneous power consumption is extremely high. Therefore, such driving is not performed.

FIG. 11 shows that ink droplets are simultaneously ejected from the same-numbered nozzles 1 to 4. Moreover, control is executed so that ink droplets are sequentially ejected from the nozzles 1 to 4 in increasing numerical order.

Accordingly, ink droplets are first ejected from two nozzles 1 (the first and fifth from the left) to form dots D1 on printing paper. When a predetermined time elapses after that time, ink droplets are ejected from two nozzles 2 to form dots D2 on the printing paper. Further, when the predetermined time elapses after that time, ink droplets are ejected from two nozzles 3 to form dots D3 on the printing paper. Furthermore, when the predetermined time elapses after that time, ink droplets are ejected from two nozzles 4 to form dots D4. In this way, eight dots D1 to D4 are arranged on one line.

In this case, when it is assumed that the time from when ink droplets are ejected from the nozzles 1 to form dots D1 on the printing paper to when ink droplets are ejected from the nozzles 2 to form dots D2 on the printing paper is represented by t (that is, the predetermined time is t) and the feeding speed of the printing paper is represented by v, the moving distance x of the printing paper during the time t is given as follows:

$$X=v\times t$$

That is, as shown in FIG. 11, the distance (displacement) between the dots D1 and D2 in the Y-direction (feeding direction of printing paper) is equal to the above distance x. This also applies to the distance between the dots D2 and D3, and the distance between the dots D3 and D4.

Although forming positions of dots (landing positions of ink droplets) shown by dotted circles in FIG. 11 are ideal, actual dots are formed at the positions shown by diagonally shaded circles, and the dots D1 to D4 are not arrayed on a line parallel to the X-direction.

As a result, an actually formed image is not an exact straight line, but is a serrated pattern. This phenomenon similarly occurs not only when a straight line is formed, but also when other patterns are formed, and lowers print quality.

Accordingly, the nozzles 1 to 4 of the liquid ejecting parts that perform ejection at different times are conventionally not aligned in the Y-direction, as shown in FIG. 12. The distance between the nozzles 1 and 2 in the Y-direction is equal to the above-described distance x. This also applies to the distance between the nozzles 2 and 23, and the distance between the nozzles 3 and 4. Each two nozzles 1, 2, 3, or 4 are disposed on a line parallel to the X-direction.

With this arrangement of the nozzles 1 to 4, even when ink droplets are sequentially ejected from the nozzles 1, the nozzles 2, the nozzles 3, and the nozzles 4 at different times, all dots D1 to D4 can be placed on a line parallel to the X-direction on the printing paper.

In the above related art, however, when a plurality of nozzles 1 to 4 of the head are arranged in a form other than the linear form, as shown in FIG. 12, first, production cost increases.

Secondly, a process of inspecting the positions of the nozzles is performed after the production of the head, the inspection is performed by image recognition, and therefore, when the nozzles are arranged in a form other than the linear form, the inspection time is longer than that for nozzles arranged in a linear form. The production cost is thereby increased.

Thirdly, when the nozzles are arranged in a form other than the linear form, as shown in FIG. 12, sharing of the head is impossible. For example, the distance between the nozzles 1 and 2 in the Y-direction in FIG. 12 is determined to be equal to the above-described distance x. However, since the distance x is a function determined by the feeding speed of the printing paper in the Y-direction in the printer and the time t, the use of the head in which the distance between the nozzles 1 and 2 in the Y-direction is determined beforehand limits the feeding speed of the printing paper and the time t.

Fourthly, although the four types of nozzles 1 to 4 are arranged so that the nozzles of each type are aligned on the same line in the X-direction in the example shown in FIG. 12, in a case in which the positions of the nozzles are determined beforehand, when ink droplets are ejected at different times, they can always be ejected only in the order based on the nozzle arrangement.

DISCLOSURE OF INVENTION

Accordingly, an object of the present invention is to array dots in line even when nozzles are arrayed in line and ink droplets are ejected from a plurality of liquid ejecting parts with a time difference.

The present invention solves the above problems by the following solving means.

The present invention provides a liquid ejecting apparatus including a head having a plurality of liquid ejecting parts juxtaposed to array nozzles in line, wherein each of the liquid ejecting parts includes a liquid chamber containing liquid to be ejected; a bubble generating means provided in the liquid chamber to generate a bubble in the liquid inside the liquid chamber by the supply of energy; and a nozzle forming member that forms the nozzles for ejecting the liquid in the liquid chamber in response to the generation of the bubble by the bubble generating means, wherein the liquid ejecting apparatus applies droplets ejected from the nozzles in the liquid ejecting parts onto a droplet landing object that moves relative to the head in a direction perpendicular to the array direction of the nozzles, wherein the bubble generating means includes a plurality of bubble generating means juxtaposed in the liquid chamber at least in the direction perpendicular to the array direction of the nozzles, and wherein the liquid ejecting apparatus further includes an ejecting-direction changing means for changing the ejecting direction of the droplets ejected from the nozzles to a plurality of different directions along the direction perpendicular to the array direction of the nozzles by supplying the energy to at least one and at least another one of the plurality of bubble generating means, which are juxtaposed in the direction perpendicular to the array direction of the nozzles in the liquid chamber, in different manners; a time-difference ejection means for controlling ejection of droplets from a first liquid ejecting part, of the plurality of liquid ejecting parts, and a second liquid ejecting part different from the first liquid ejecting part so that a droplet is ejected from the second liquid ejecting part when a predetermined time elapses after a droplet is ejected from the first liquid ejecting part; and an ejecting-direction control means for controlling the ejection of the droplets from the first liquid ejecting part and the second liquid ejecting part by the time-difference ejection means so that the ejecting direction of the droplet ejected from the first liquid ejecting part and the ejecting direction of the droplet ejected from the second ejecting part are made different by using the ejecting-direction changing means, and so that the distance between the landing position of the droplet ejected from the first liquid ejecting part and the landing position of the droplet ejected from the second liquid ejecting part in the direction perpendicular to the array direction of the nozzles is shorter than a relative moving distance for which the head and the droplet landing object relatively move from when the droplet ejected from the first liquid ejecting part lands to when the droplet ejected from the second liquid ejecting part lands.

In the above invention, the nozzles of the head are arrayed in a linear form. The ejecting-direction changing means allows droplets to be ejected from the nozzles in a plurality of different directions perpendicular to the array direction of the nozzles.

With the time-difference ejection means, a droplet is ejected from the nozzle of the second liquid ejecting part when a predetermined elapses after a droplet is ejected from the nozzle of the first ejecting part.

In this case, the ejecting-direction control means executes control such that the ejecting direction of the droplet ejected from the first liquid ejecting part is different from the ejecting direction of the droplet ejected from the second liquid ejecting part, and such that the distance between the landing position of the droplet ejected from the first liquid ejecting part and the landing position of the droplet ejected from the second liquid ejecting part in the direction perpendicular to the array direction of the nozzles is shorter than the relative moving distance between the head and the droplet landing object.

Therefore, the displacement of the landing positions of the droplets due to the relative moving distance between the head and the droplet landing object can be reduced when droplets are ejected with a time difference.

BRIEF DESCRIPTION OF THE DRAWINGS

FIG. 3 includes a plan view and a right side sectional view showing the arrangement of heating resistors in the head in more detail (first embodiment).

FIG. 9 includes a plan view and a right side sectional view showing the arrangement of heating resistors in a head in more detail (third embodiment).

FIG. 10 includes a plan view and a right side sectional view showing the arrangement of heating resistors in a head in more detail (fourth embodiment).

BEST MODE FOR CARRYING OUT THE INVENTION

An embodiment of the present invention will be described below with reference to the drawings. In this specification, an "ink droplet" refers to a minute amount of (e.g., approximately several picoliters of) ink (liquid) ejected from a nozzle 18 of a liquid ejecting part that will be described below. A "dot" is formed by one ink droplet landing on a droplet landing object such as printing paper.

First Embodiment

Figure 1:
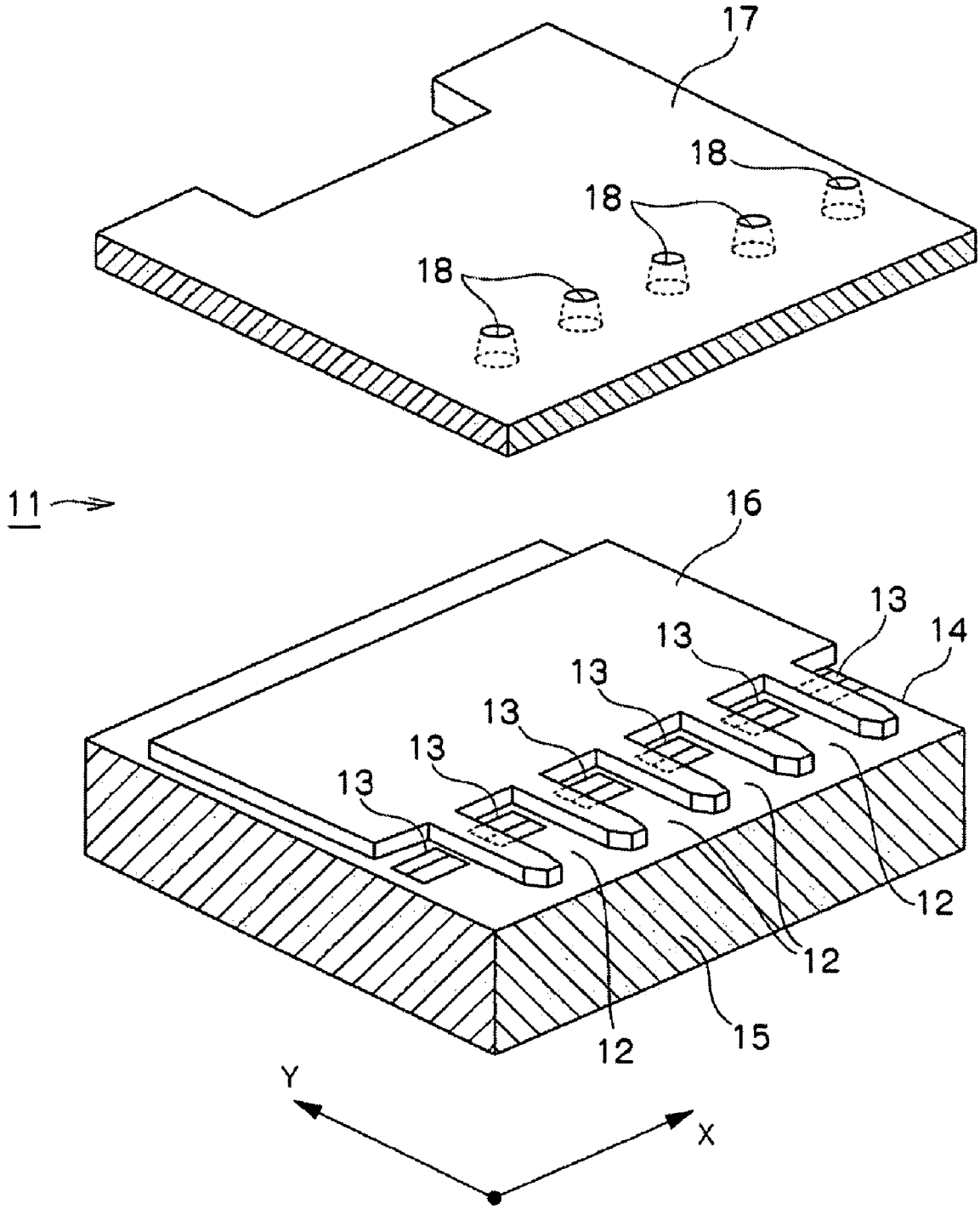
FIG. 1 is an exploded perspective view of a head of an inkjet printer to which a liquid ejecting apparatus of the present invention is applied.

FIG. 1 is an exploded perspective view of a head 11 in an inkjet printer (hereinafter simply referred to as a "printer") to which a liquid ejecting apparatus of the present invention is applied.

(Structure of Head)

Referring to FIG. 1, a head 11 includes a plurality of liquid ejecting parts arranged side by side. Each of the liquid ejecting parts includes an ink chamber 12 containing liquid to be ejected, a heating resistor 13 (corresponding to the bubble generating means in the present invention) disposed inside the ink chamber 12 to generate a bubble in the liquid in the ink chamber 12 by the supply of energy, and a nozzle sheet 17 (corresponding to the nozzle forming member in the present invention) having nozzles 18 for ejecting the liquid from the ink chamber 12 in response to the generation of the bubble by the heating resistor 13. The nozzles 18 in the liquid ejecting parts are arranged in line (in a straight line).

The nozzle sheet 17 is stuck onto a barrier layer 16. The nozzle sheet 17 is shown in an exploded manner in FIG. 1.

In the head 11, a base member 14 includes a semiconductor substrate 15 made of silicon or other materials, and heating resistors 13 formed by deposition on one surface of the semiconductor substrate 15. The heating resistors 13 are electrically connected to an external circuit via a conducting portion (not shown) provided on the semiconductor substrate 15.

The barrier layer 16 is made, for example, of a photosensitive cyclized rubber resist or an exposure-curable dry film resist, and is formed by applying the resist onto the entire surface of the semiconductor substrate 15 on which the heating resistors 13 are provided, and then removing unnecessary portions thereof by a photolithographic process.

The nozzle sheet 17 is provided with a plurality of nozzles 18, and is formed by, for example, electroforming of nickel. The nozzle sheet 17 is stuck on the barrier layer 16 so that the nozzles 18 are aligned with the heating resistors 13, that is, so that the nozzles 18 oppose the heating resistors 13.

The ink chambers 12 are defined by the base member 14, the barrier layer 16, and the nozzle sheet 17 so as to surround the heating resistor 13. That is, in the figure, the base member 14 defines bottom walls of the ink chambers 12, the barrier layer 16 defines side walls of the ink chambers 12, and the nozzle sheet 17 defines ceiling walls of the ink chambers 12. With this, the ink chambers 12 have open regions on the right front side of FIG. 1, and the open regions communicate with an ink channel (not shown).

One head 11 generally includes hundreds of ink chambers 12 and heating resistors 13 respectively disposed in the ink chambers 12. By commands from a control unit of the printer, the heating resistors 13 can be uniquely selected, and the ink in the ink chambers 12 corresponding to the selected heating resistors 13 can be ejected from the nozzles 18 opposing the ink chambers 12.

That is, the ink chambers 12 are filled with ink supplied from an ink tank (not shown) coupled to the head 11. By passing a pulse current through the heating resistor 13 for a short time, for example, 1 to 3 μsec, the heating resistor 13 is rapidly heated. As a result, an ink bubble in vapor phase is generated at a portion in contact with the heating resistor 13, and expansion of the ink bubble pushes away a certain volume of ink (the ink boils). Consequently, ink, which lies at an ink portion in contact with the nozzle 18 and has a volume equivalent to the volume of the pushed-away ink, is ejected as an ink droplet from the nozzle 18, and lands on a droplet landing object such as printing paper to form a dot.

In this specification, the direction in which the liquid ejecting parts (nozzles 18) are arranged is defined as an "X-direction", as shown in FIG. 1. The direction perpendicular (orthogonal) to the X-direction is defined as a "Y-direction".

Figure 2:
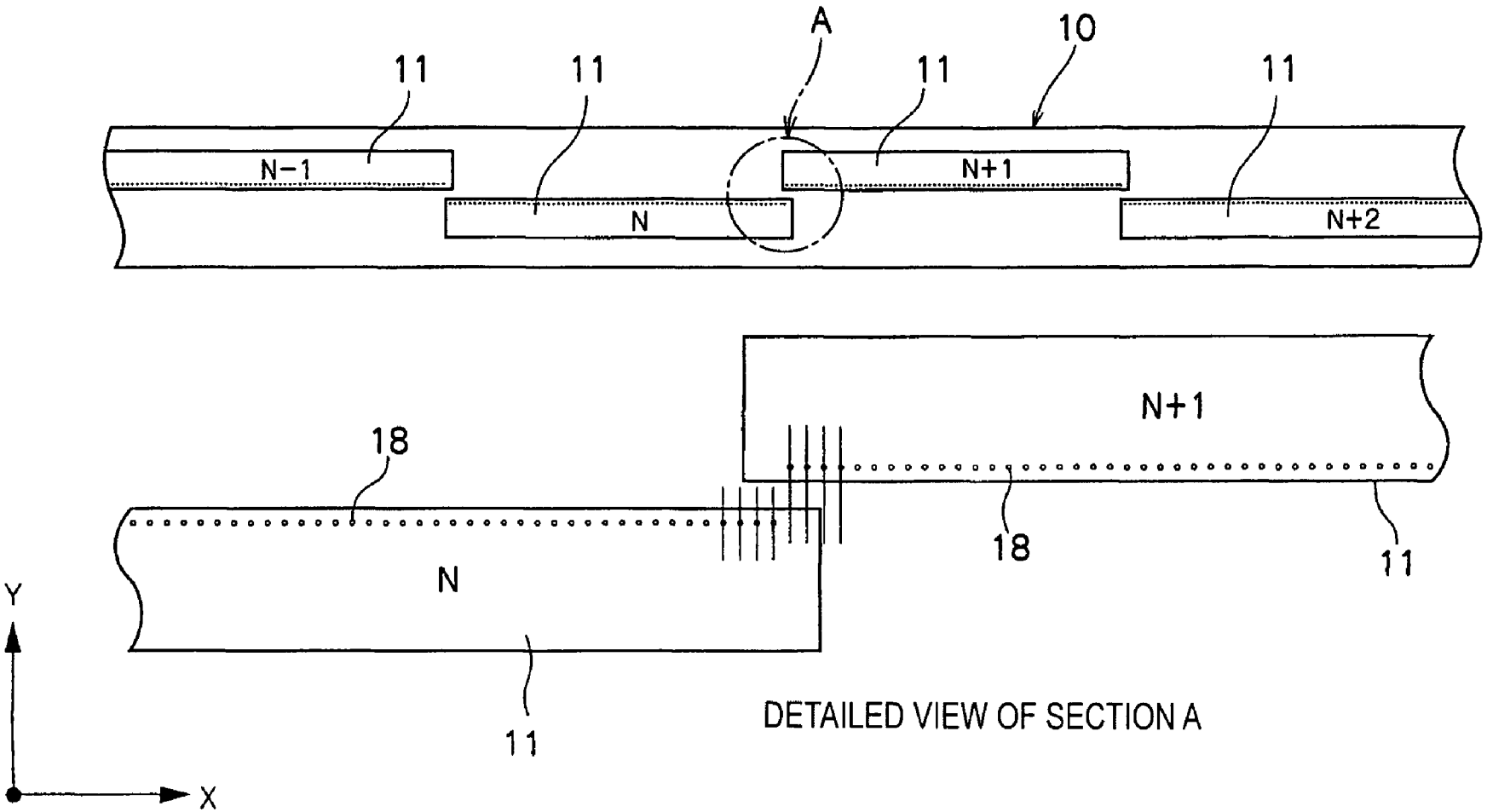
FIG. 2 is a plan view of an embodiment of a line head.

In this embodiment, a plurality of heads 11 are arranged so as to be connected in the X-direction (width direction of the printing paper) to constitute a line head in which nozzles 18 of the heads 11 are arranged in line. FIG. 2 is a plan view of an embodiment of a line head 10. While four heads 11 (N−1, N, N+1, and N+2) are shown in FIG. 2, more heads 11 are arranged so as to be connected.

In order to form the line head 10, a plurality of portions (head chips), each obtained by removing the nozzle sheet 17 from the head 11 in FIG. 1, are first arranged side by side.

Then, one nozzle sheet 17 provided with nozzles 18 lying directly above heating resistors 13 of all the heat chips is stuck on the upper sides of the head chips to form the line head 10.

Alternatively, the line head is formed by, for example, preparing one nozzle sheet 17 provided with nozzles 18 that are formed to lie directly above the heating resistors 13 of all the head chips, and sticking the nozzle sheet 17 while positioning the head chips.

While the line head 10 for one color is shown in FIG. 2, a plurality of line heads 10 may be provided to form a color line head that supplies inks of different colors to the line heads 10.

Adjoining heads 11 are disposed on one side and the other side of one ink channel extending in the X-direction, and the head 11 on one side and the head 11 on the other side are arranged opposed to each other, that is, each head 11 on one side is disposed at a position turned 180 degrees with respect to the adjoining head 11 so that the nozzles 18 thereof oppose each other (so-called staggered arrangement). That is, in FIG. 2, a portion between a line connecting outer edges of nozzles of the (N−1)-th and (N+1)-th heads 11 and a line connecting outer edges of nozzles 18 of the N-th and (N+2)-th heads 11 serves as an ink channel of the line head 10.

Furthermore, the heads 11 are arranged so that the pitch between the nozzles 18 located at the ends of the adjoining heads 11, that is, the interval between the nozzle 18 located at the right end of the N-th head 11 and the nozzle 18 located at the left end of the (N+1)-th head 11 in a detailed view of a section A in FIG. 2 is equal to the interval between the nozzles 18 in the heads 11.

Instead of being arranged in a so-called staggered manner, as described above, the heads 11 may be arranged so that the liquid ejecting parts thereof are arranged in line (in a straight line). That is, in FIG. 2, the N-th and (N+2)-th heads 11 may be disposed so as to face in the same direction as that of the (N−1)-th and (N+1)-th heads 11.

(Ejecting Direction Changing Means)

The head 11 also includes an ejecting direction changing means.

In this embodiment, the ejecting direction changing means can change the ejecting direction of ink droplets ejected from the nozzles 18 of the liquid ejecting parts to a plurality of directions along the Y-direction. The ejecting direction changing means has the following structure in this embodiment.

FIG. 3 includes a plan view and a right side sectional view illustrating the arrangement of heating resistors 13 in the head 11 in more detail. In the plan view of FIG. 3, the position of the nozzle 18 is also shown by one-dot chain lines.

As shown in FIG. 3, two heating resistors 13 are juxtaposed in one ink chamber 12 of the head 11 in this embodiment. The two heating resistors 13 are arranged in the Y-direction.

In this embodiment, the two heating resistors 13 are formed by splitting one heating resistor in two. When one heating resistor 13 is thus split in two, the length is not changed, and the width is halved. Therefore, the resistance of the heating resistor 13 is doubled. By connecting the two heating resistors 13 in series, the heating resistors 13, each having the doubled resistance, are connected in series, so that the resistance is multiplied by four.

In order to boil the ink in the ink chamber 12, the heating resistors 13 need to be heated by applying a fixed power thereto. This is because ink is ejected by energy produced during boiling. Although a current to be applied needs to be large when the resistance is low, boiling can be achieved with a small current by increasing the resistance of the heating resistors 13.

This reduces the size of a transistor or the like that applies the current, and thereby allows space saving. Although the resistance can be increased by reducing the thickness of the heating resistor 13, there is a certain limitation to the reduction in thickness of the heating resistor 13, from the viewpoints of material and strength (durability) selected for the heating resistor 13. For this reason, the resistance of the heating resistor 13 is increased by splitting without reducing the thickness.

In a case in which the two heating resistors 13 are provided in one ink chamber 12, when the periods of time taken for the individual heating resistors 13 to reach the temperature for boiling the ink (bubble generation times) are equal, the ink boils simultaneously on the two heating resistors 13, so that an ink droplet is ejected in the direction of the center line of the nozzle 18.

In contrast, when a difference is provided between the bubble generation times of the two heating resistors 13, the ink does not boil simultaneously on the two heating resistors 13. Therefore, an ink droplet is ejected in a direction deviating (deflected) from the direction of the center line of the nozzle 18. Consequently, the ink droplet lands on a position deviating from a position where the ink droplet lands when it is ejected without deflection.

Figure 4A:
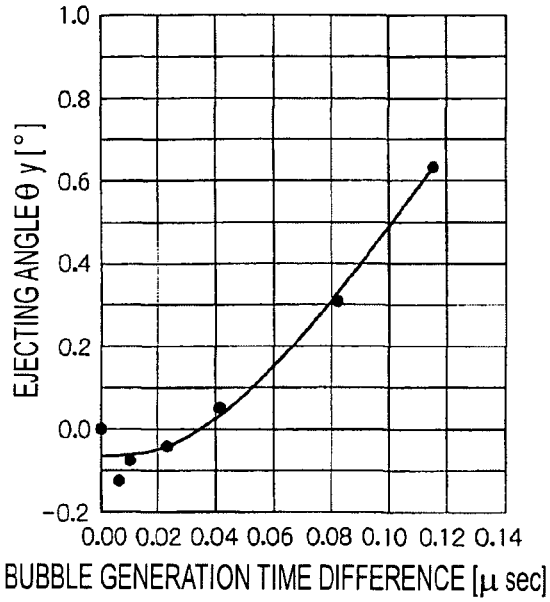
FIGS. 4A to 4C are graphs showing the relationship between the difference between the ink bubble generation times of two juxtaposed heating resistors, and the ejecting angle of an ink droplet.
Figure 4B:
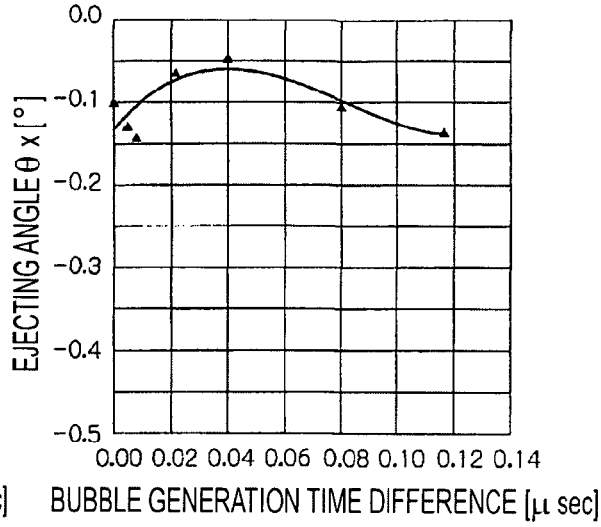

FIGS. 4A and 4B are graphs showing the relationship between the difference in the ink bubble generation time between two heating resistors 13 provided as in this embodiment, and the ejecting angle of an ink droplet. Values in these graphs are obtained by computer simulations. In the graphs, the Y-direction (a direction indicated by the vertical axis θy of the graph. Note: this does not mean the vertical axis of the graph.) is a direction (array direction of the heating resistors 13) perpendicular to the array direction of the nozzles 18, as described above, and the X-direction (a direction indicated by the vertical axis θx of the graph. Note: this does not mean the horizontal axis of the graph.) coincides with the array direction of the nozzles 18, as described above. In both the X- and Y-directions, there is shown the amount of deviation from the angle 0° in the direction of the center axis of the nozzle 18.

Figure 4C:
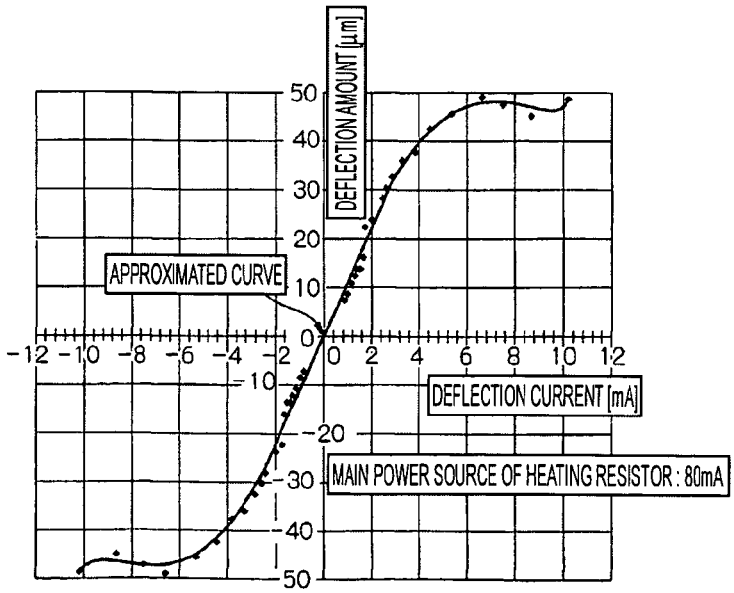

FIG. 4C shows data on the ink bubble generation time difference between the two heating resistors 13 actually measured when the horizontal axis indicates the half of a difference in current between the two heating resistors 13 as a deflection current, and the vertical axis indicates the amount of deflection of a landing position of an ink droplet (actually measured when the distance between the nozzle 18 and the landing position is approximately 2 mm) as an ejecting angle of the ink droplet in the Y-direction. In FIG. 4C, deflection ejection of an ink droplet was performed while a main current of the heating resistors 13 was 80 mA and the deflection current is superimposed on the current applied to one of the heating resistors 13.

When there is a difference between the bubble generation times of two heating resistors 13 juxtaposed in the Y-direction, the ejecting angle of an ink droplet is not perpendicular, and the ejecting angle θy of the ink droplet in the Y-direction increases as the difference between the bubble generation times increases.

Accordingly, in this embodiment, the ejecting direction of the ink droplet can be changed to a plurality of directions while executing control such as to form a difference between the bubble generation times of the two heating resistors 13 by utilizing this characteristic, that is, by changing the amount of current to be applied to the two heating resistors 13.

For example, when the resistances of the two heating resistors 13 are not equal because of a production error, a difference is made between the bubble generation times of the two heating resistors 13. Therefore, the ejecting angle of the ink droplet is not perpendicular, and the landing position of the ink droplet deviates from a position where the ink droplet should land. However, the ejecting angle of the ink droplet can be made perpendicular by changing the amount of current to be applied to the two heating resistors 13 in order to control the bubble generation times of the heating resistors 13 to be the same.

Figure 5:
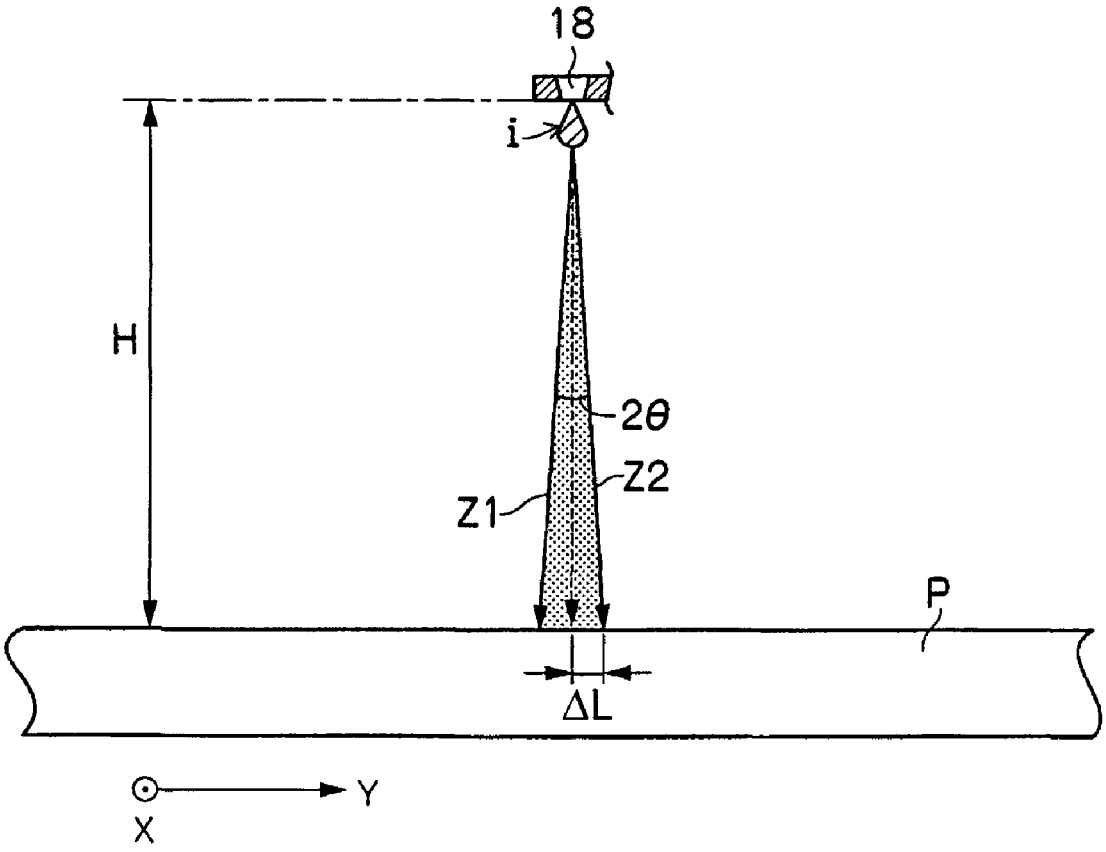
FIG. 5 is a view explaining the ejecting direction of the ink droplet.

FIG. 5 is a view explaining the ejecting direction of an ink droplet. In FIG. 5, when an ink droplet i is ejected perpendicularly to an ejection surface (surface of printing paper P) for the ink droplet i, it is ejected without being deflected, as shown by the broken-line arrow in FIG. 5. In contrast, when the ejecting direction of the ink droplet i deviates by θ from the perpendicular direction (in the Z1- or Z2-direction in FIG. 5), the landing position of the ink droplet i deviates by ΔL which is obtained by the following expression:

$$\Delta L = H \times \tan\theta$$

In this way, when the ejecting direction of the ink droplet i deviates by θ from the perpendicular direction, the landing position of the ink droplet deviates by ΔL.

The distance H between the tip of the nozzle 18 and the printing paper P is approximately 1 mm to 2 mm in normal inkjet printers. Therefore, it is assumed that the distance H is kept constant to be approximately 2 mm.

The distance H needs to be substantially fixed because the landing position of the ink droplet i varies if the distance H varies. That is, when the ink droplet i is perpendicularly ejected from the nozzle 18 onto the surface of the printing paper P, the landing position of the ink droplet i does not vary even when the distance H varies slightly. In contrast, when the ink droplet i is ejected with deflection, as described above, the landing position of the ink droplet i differs with the change of the distance H.

When the printing resolution is 600 dpi, the pitch between the N-th pixel line and the (N+1)-th pixel line adjacent thereto is given by the following expression:

$$25.40 \times 1000/600 \approx 42.3\ (\mu m)$$

Accordingly, in order to eject the ink droplet in the Z1- or Z2-direction in FIG. 5 so that the ink droplet lands on the adjacent pixel line, ΔL is set as follows:

$$\Delta L = 42.3\ (\mu m)$$

In this case, the ejecting angle θ is set as follows:

$$\theta = \tan^{-1}(\Delta L/H) \approx \tan^{-1}(0.021)$$

Figure 6:
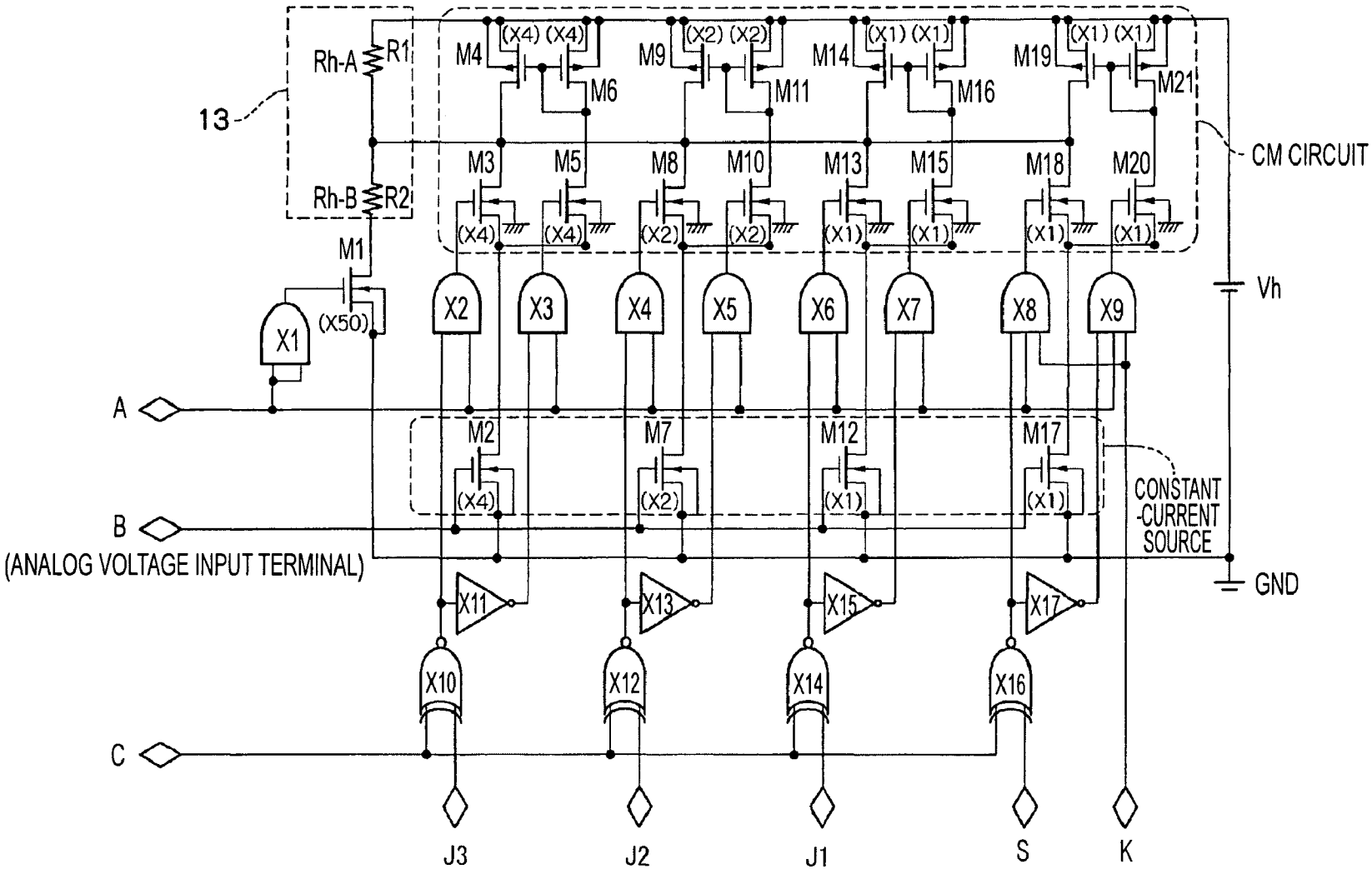
FIG. 6 is a diagram of an ejection control circuit in this embodiment.

FIG. 6 is a diagram of an ejection control circuit 50 that embodies the ejecting direction changing means in this embodiment.

In this embodiment, the ejecting direction changing means executes control such that the ejecting direction of the ink droplet changes to at least two different directions by changing the energy supplied to the two heating resistors 13.

More specifically, two heating resistors 13 in the ink chamber 12 are connected in series, and the ejecting direction changing means includes a circuit having a switching element connected between the heating resistors 13 connected in series (a current mirror circuit (CM circuit) in this embodiment). The amount of current supplied to the heating resistors 13 is controlled by causing a current to be put between the heating resistors 13 or taken out from therebetween via the circuit so that the ejecting direction of the ink droplet changes to at least two different directions.

First, a description will be given of elements used in the ejection control circuit 50 and the connecting states thereof with reference to FIG. 6.

Resistors Rh-A and Rh-B are resistors for the above-describe two-split heating resistors 13, and are connected in series. A power source Vh is a power source for applying a voltage to the resistors Rh-A and Rh-B.

The circuit shown in FIG. 6 includes transistors M1 to M21. The transistors M4, M6, M9, M11, M14, M16, M19, and M21 are PMOS transistors, and the others are NMOS transistors. In the circuit shown in FIG. 6, for example, the transistors M2, M3, M4, M5, and M6 constitute a set of CM circuits, and four sets of CM circuits are provided in total.

In this circuit, a gate and a drain of the transistor M6 and a gate of the transistor M4 are connected. Drains of the transistors M4 and M3 are connected, and drains of the transistors M6 and M5 are connected. This also applies to the other CM circuits.

Drains of the transistors M4, M9, M14, and M19 and drains of the transistors M3, M8, M13 and M18, constituting parts of the CM circuits, are connected to the midpoint between the resistors Rh-A and Rh-B.

Further, the transistors M2, M7, M12, and M17 serve as constant-current sources for the CM circuits, and their drains are connected to sources of the transistors M3, M8, M13, and M18, respectively.

The transistor M1 has its drain connected in series to the resistor Rh-B so that it is turned ON to pass a current through the resistors Rh-A and Rh-B when an ejection execution input switch A becomes 1 (ON).

In this embodiment, when an ink droplet is ejected from one liquid ejecting part, the ejection execution input switch A is set at 1 (ON) only for a period of 1.5 μs (1/64), and power is supplied from the power source Vh to the resistors Rh-A and Rh-B. For a period of 94.5 μs (63/64), the ejection execution input switch A is 0 (OFF), and this period is used to replenish ink into the ink chamber 12 of the liquid ejecting part from which the ink droplet has been ejected.

Output terminals of AND gates X1 to X9 are connected to the gates of the transistors M1, M3, M5, M8, M10, M13, M15, M18, and M20, respectively. The AND gates X1 to X7 are of a two-input type, and the AND gates X8 and X9 are of a three-input type. At least one of input terminals of the AND gates X1 to X9 is connected to the ejection execution input switch A.

In addition, one of input terminals of XNOR gates X10, X12, X14 and X16 is connected to a deflection-direction selecting switch C, and the other input terminals are connected to deflection control switches J1 to J3 or to an ejection-angle correction switch S.

The deflection-direction selecting switch C is a switch used to select a side in the Y-direction to which the ejecting direction of the ink droplet is deflected. That is, the switch C is a switch used to switch the ejecting direction between the Z1-direction and the Z2-direction in FIG. 5. When the deflection-direction selecting switch C becomes 1 (ON), one of the inputs to the XNOR gate X10 becomes 1.

The deflection control switches J1 to J3 are switches used to determine the amount of deflection of the ink ejecting direction. For example, when the deflection control switch J3 becomes 1 (ON), one of the inputs to the XNOR gate X10 becomes 1.

Further, each of the output terminals of the XNOR gates X10, X12, X14, and X16 is connected to one of the input terminals of each of the AND gates X2, X4, X6, and X8, and is connected to one of the input terminals of each of the AND gates X3, X5, X7, and X9 via NOT gates X11, X13, X15, and X17. Moreover, one of the input terminals of each of the AND gates X8 and X9 is connected to an ejection-angle correction switch K.

Furthermore, a deflection-amplitude control terminal B is a terminal for determining the amplitude in one deflection step, and for determining current values of the transistors M2, M7, M12, and M17 serving as the constant-current sources for the CM circuits, and is connected to the gates of the transistors M2, M7, M12, and M17. By setting the terminal at 0 V, the currents of the constant-current sources become 0, a deflection current does not flow, and consequently, the deflection amplitude can become 0. That is, an ink droplet is ejected in the direction shown by the broken-line arrow in FIG. 5 (direction perpendicular to the surface of the printing paper P). By gradually increasing the voltage, the current value gradually increases, much deflection current can flow, and the deflection amplitude (the angle θ in FIG. 5) can also increase. That is, the deflection amplitude can be appropriately controlled by the voltage applied to the terminal.

The source of the transistor M1 connected to the resistor Rh-B and the sources of the transistors M2, M7, M12, and M17 serving as the constant-current sources for the CM circuits are connected to the ground (GND).

In the above configuration, numerals in "×N (N=1, 2, 4, or 50)" parenthesized and added to each of the transistors M1 to M21 represent the parallel conditions of elements. For example, "×1" (M12 to M21) indicates that a standard element is provided, and "×2" (M7 to M11) indicates that an element equivalent to two standard elements connected in parallel is provided. In the following, "×N" indicates that an element equivalent to N standard elements connected in parallel is provided.

Accordingly, since the transistors M2, M7, M12, and M17 have "×4", "×2", "×1", and "×1", respectively, when an appropriate voltage is applied between the gate of each of these transistors and the ground, the ratio of their drain currents is 4:2:1:1.

Next, the operation of the ejection control circuit 50 will be described. First, a description will be given of only the CM circuit constituted by the transistors M3, M4, M5, and M6.

The ejection execution input switch A becomes 1 (ON) only when ink is ejected.

For example, when A=1, B=2.5 V (applied), C=1, and J3=1, the output from the XNOR gate 10 is 1, and this output 1 and A=1 are input to the AND gate X2, so that the output from the AND gate X2 is 1. Therefore, the transistor M3 is turned ON.

When the output from the XNOR gate X10 is 1, the output from the NOT gate X11 is 0. Therefore, this output 0 and A=1 are input to the AND gate X3. Consequently, the output from the AND gate X3 is 0, and the transistor M5 is turned OFF.

Since the drains of the transistors M4 and M3 are connected and the drains of the transistors M6 and M5 are connected, when the transistor M3 is ON and the transistor M5 is OFF, as described above, a current flows from the transistor M4 to the transistor M3, but no current flows from the transistor M6 to the transistor M5. In addition, because of the characteristics of the CM circuit, when no current flows through the transistor M6, no current flows through the transistor M4. Further, since 2.5 V is applied to the gate of the transistor M2, a corresponding current flows only from the transistor M3, among the transistors M3, M4, M5, and M6, to the transistor M2 in the above case.

Since the gate of the transistor M5 is OFF in this state, no current flows through the transistor M6, and no current also flows through the transistor M4 serving as a mirror thereof. While the same current should flow through the resistors Rh-A and Rh-B, when the gate of the transistor M3 is ON, since a current value determined by the transistor M2 is taken out from the midpoint between the resistors Rh-A and Rh-B via the transistor M3, it is added only to a current flowing through the resistance Rh-A. Therefore, the following relationship is provided:

$I_{Rh\text{-}A}$ (current flowing through the resistor Rh-A) $>I_{Rh\text{-}B}$ (current flowing through the resistor Rh-B)

The above description is given in the case in which C=1. Next, the following description will be given in a case in which C=0, that is, only the input to the deflection-direction selecting switch C is changed (A=1, B=2.5 V applied, and J3=1, similarly to the above).

When C=0 and J3=1, the output from the XNOR gate X10 is 0. In this case, the inputs to the AND gate X2 are (0, 1 (A=1)), so that the output therefrom is 0. Consequently, the transistor M3 is turned OFF.

In addition, when the output from the XNOR gate X10 becomes 0, the output from the NOT gate X11 becomes 1, so that the inputs to the AND gate X3 are (1, 1 (A=1)), and the transistor M5 is turned ON.

When the transistor M5 is ON, a current flows through the transistor M6, and a current also flows through the transistor M4 because of the characteristics of the CM circuit.

Therefore, the power source Vh passes a current through the resistor Rh-A, the transistor M4, and the transistor M6. Then, the current flowing through the resistor Rh-A entirely flows through the resistor Rh-B (since the transistor M3 is OFF, the current flowing out of the resistor Rh-A is not branched to the side of the transistor M3). In addition, the current flowing through the transistor M4 entirely flows into the resistor Rh-B because the transistor M3 is OFF. Further, the current flowing through the transistor M6 flows into the transistor M5.

From the above, when C=1, the current flowing through the resistor Rh-A is branched to the resistor Rh-B and the transistor M3. On the other hand, when C=0, not only the current flowing through the resistor Rh-A, but also the current flowing through the transistor M4 flows into the resistor Rh-B. As a result, the currents flowing through the resistor Rh-A and the resistor Rh-B are in the following relationship:

$$I_{Rh\text{-}A}<I_{Rh\text{-}B}$$

The ratios of the currents are symmetrical between the case where C=1 and the case where C=0.

By setting the currents flowing through the resistors Rh-A and Rh-B to be different in the above manner, a difference can be made between the bubble generation times on the two heating resistors 13. This can deflect the ink ejecting direction.

Moreover, the ink deflecting direction can be switched to the symmetrical positions in the array direction of the nozzles 18 between the case where C=1 and the case where C=0.

While the above description has been given of the case in which only the deflection control switch J3 is turned ON/OFF, the currents flowing through the resistors Rh-A and Rh-B can be more finely set by also turning the deflection control switches J2 and J1 ON/OFF.

That is, the currents flowing through the transistors M4 and M6 can be controlled by using the deflection control switch J3, while the currents flowing through the transistors M9 and M11 can be controlled by using the deflection control switch J2. Further, the currents flowing through the transistors M14 and M16 can be controlled by using the deflection control switch J1.

As described above, the drain currents can be passed through the transistors in the ratio of transistors M4 and M6:transistors M9 and M11:transistors M14 and M16=4:2:1. This allows the ink deflection direction to be changed by use of three bits of signals from the deflection control switches J1 to J3 in eight stages of (J1, J2, J3)=(0, 0, 0), (0, 0, 1), (0, 1, 0), (0, 1, 1), (1, 0, 0), (1, 0, 1), (1, 1, 0), and (1, 1, 1).

In addition, since the currents can be changed by changing the voltages applied between the gates of the transistors M2, M7, M12 and M17 and the ground, the deflection amount per one stage can be changed while maintaining the ratio of the drain currents flowing through the transistors at 4:2:1.

The deflection direction can be switched symmetrically in the Y-direction by using the deflection-direction selecting switch C, as described above.

As shown in FIG. 2, a plurality of heads 11 are arranged in the X-direction in the line head 10 of this embodiment, and the heads 11 are arranged in a so-called staggered manner. In this case, when a common signal is sent from the deflection control switches J1 to J3 to the two adjacent heads 11, the deflection direction is reversed between the two adjacent heads 11. For this reason, in this embodiment, the deflection-direction selecting switch C is provided to symmetrically switch the deflection direction in one head 11.

Accordingly, when a plurality of heads 11 arranged in a so-called staggered manner to constitute the line head 10, the deflection directions of the heads 11 in the line head 10 can be made the same by setting C=1 for the even-numbered heads 11, among the heads 11 in FIG. 2, that is, the N-th, (N+2)-th, . . . heads 11 and by setting C=1 for the odd-numbered heads 11, that is, the (N−1)-th, (N+1)-th, . . . heads 11.

While the ejection-angle correction switches S and K are similar to the deflection control switches J1 to J3 in serving as switches for deflecting the ink ejecting direction, they are used to correct the ink ejecting angle.

First, the ejection-angle correction switch K is a switch for determining whether correction is performed or not. Correction is performed when K=1, and is not performed when K=0.

The ejection-angle correction switch S is a switch for determining a direction along the Y-direction in which the angle is corrected.

For example, when K=0 (correction is not performed), one of the three inputs to each of the AND gates X8 and X9 becomes 0, and therefore, outputs from both the AND gates X8 and X9 are 0. Consequently, the transistors M18 and M20 are turned OFF, and the transistors M19 and M21 are also turned OFF. Accordingly, the currents flowing through the resistor Rh-A and the resistor Rh-B do not change.

In contrast, when K=1 and, for example, it is assumed that S=0 and C=0, the output from the XNOR gate X16 is 1. Since (1, 1, 1) is thereby input to the AND gate X8, the output therefrom is 1, and the transistor M18 is turned ON. Moreover, since one of the inputs to the AND gate X9 becomes 0 via the NOT gate X17, the output from the AND gate X9 becomes 0, and the transistor M20 is turned OFF. Since the transistor M20 is OFF, no current flows through the transistor M21.

Because of the characteristics of the CM circuit, no current also flows through the transistor M19. However, since the transistor M18 is ON, a current flows out from the midpoint between the resistor Rh-A and the resistor Rh-B, and flows into the transistor M18. Therefore, the current flowing through the resistor Rh-B can be made smaller than the current flowing through the resistor Rh-A. This makes it possible to correct the ink ejecting direction and to correct the ink landing position in the Y-direction by a predetermined amount.

While correction is performed by two bits of signals from the ejection-angle correction switches S and K in the above embodiment, a finer correction can be achieved by increasing the number of switches.

When the ink ejecting direction is deflected by using the above switches J1 to J3, S, and K, the current (deflection current Id) is expressed by the following equation:

$$Id = J3 \times 4 \times Is + J2 \times 2 \times Is + J1 \times Is + S \times K \times Is = (4 \times J3 + 2 \times J2 + J1 + S \times K) \times Is \quad \text{(Equation 1)}$$

In Equation 1, +1 or −1 is assigned to J1, J2, and J3, +1 or −1 is assigned to S, and +1 or 0 is assigned to K.

As is understood from Equation 1, the deflection current Id can be set in eight stages by settings of J1, J2, and J3, and correction can be performed by S and K, independently of the settings of J1 to J3.

Since the deflection current can be set at any of four positive values and four negative values, the ink deflecting direction can be set in both directions along the array direction of the nozzles 18. For example, in FIG. 5, the ink deflecting direction can be deflected by θ from the perpendicular direction (direction shown by the broken arrow) to the left (Z1-direction in the figure), or can be deflected by θ to the right (Z2-direction in the figure). Furthermore, the value θ, that is, the amount of deflection can be arbitrarily set, as described above.

(Time-Difference Ejection Means, Ejecting-Direction Control Means)

The printer of this embodiment includes a time-difference ejection means and an ejecting-direction control means.

When ink droplets are respectively ejected from a first liquid ejecting part, of a plurality of liquid ejecting parts, and a second liquid ejecting part different from the first liquid ejecting part, the time-difference ejection means executes control such that an ink droplet is ejected from the second liquid ejecting part when a predetermined time elapses after ejection of an ink droplet from the first liquid ejecting part.

When ink droplets are respectively ejected from the first liquid ejecting part and the second liquid ejecting part by the time-difference ejection means, the ejecting-direction control means executes control, by using the ejecting direction changing means, so that the ejecting direction of the ink droplet ejected from the first liquid ejecting part is made different from the ejecting direction of the ink droplet ejected from the second liquid ejecting part, and so that the distance in the Y-direction between the landing position of the ink droplet ejected from the first liquid ejecting part and the landing position of the ink droplet ejected from the second liquid ejecting part is shorter than the relative moving distance for which the head 11 and the printing paper relatively move from when the ink droplet ejected from the first liquid ejecting part lands to when the ink droplet ejected from the second liquid ejecting part lands.

In this embodiment, particularly, when ink droplets are respectively ejected from a first liquid ejecting part group including a plurality of liquid ejecting parts that do not adjoin one another, and a second liquid ejecting part group including a plurality of liquid ejecting parts that do not adjoin one another, the time-difference ejection means executes control such that ink droplets are ejected from the liquid ejecting parts of the second liquid ejecting part group when a predetermined time elapses after ejection of ink droplets from the liquid ejecting parts of the first liquid ejecting part group.

When ink droplets are ejected from the liquid ejecting parts of the first liquid ejecting part group and the second liquid ejecting part group by the time-difference ejection means, the ejecting-direction control means executes control to eject the ink droplets from the liquid ejecting parts of the first liquid ejecting part group in a fixed direction so that the landing positions of the ink droplets ejected from the liquid ejecting parts of the first liquid ejecting part group are arranged on a first line parallel to the X-direction, and to eject the ink droplets from the liquid ejecting parts of the second liquid ejecting part group in a fixed direction so that the landing positions of the ink droplets ejected from the liquid ejecting parts of the second liquid ejecting part group are arranged on a second line parallel to the X-direction. By using the ejecting direction changing means, the ejecting-direction control means executes control such that the ejecting direction of the ink droplets ejected from the liquid ejecting parts of the first liquid ejecting part group is made different from the ejecting direction of the ink droplets ejected from the liquid ejecting parts of the second liquid ejecting part group, and such that the distance in the Y-direction between the first line and the second line is shorter than the relative moving distance for which the head 11 and the printing paper relatively move from when the ink droplets ejected from the liquid ejecting parts of the first liquid ejecting part group land to when the ink droplets ejected from the liquid ejecting parts of the second liquid ejecting part group land.

Figure 7:
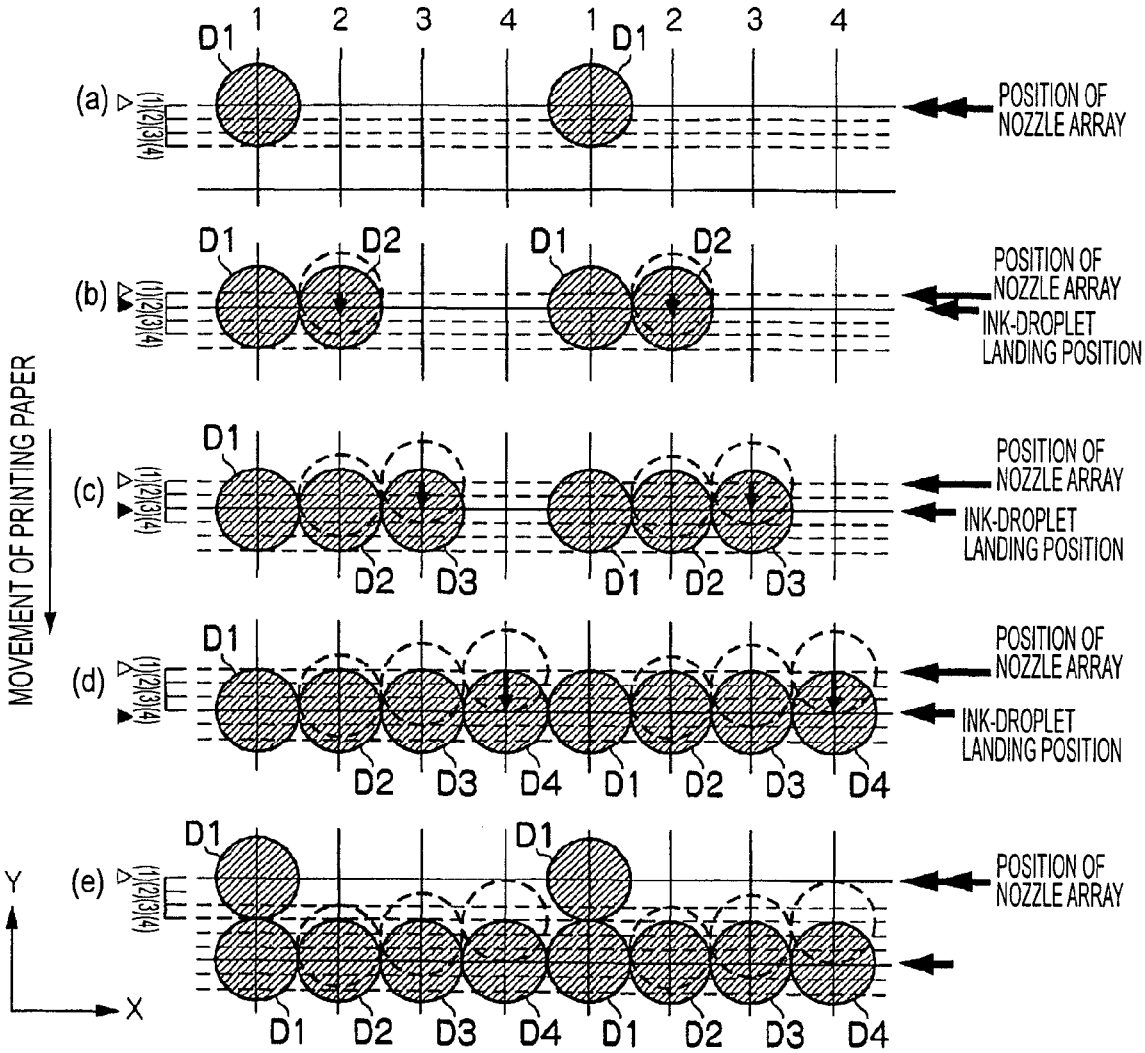
FIG. 7 is a plan view explaining the control of ejection of ink droplets executed by a time-difference ejection means and an ejecting-direction control means (first embodiment).

FIG. 7 is a plan view explaining of control of the ejection of ink droplets by the time-difference ejection means and the ejecting-direction control means.

In FIG. 7, the X-direction refers to the array direction of the nozzles 18 (liquid ejecting parts) and the Y-direction refers to the feeding direction of printing paper, as described above. It is assumed that liquid ejecting parts respectively belonging to the first, second, third, fourth, first, second, third, and fourth liquid ejecting part groups are arranged in this order from the left side in the head 11 (in actuality, more liquid ejecting parts are arranged). Dots D1 to D4 are formed by ink droplets ejected from the liquid ejecting parts of the first to fourth liquid ejecting part groups.

In FIG. 7, the head 11 is fixed, and the printing paper is moved in the Y-direction in the figure. While the printing paper is being moved in the Y-direction in the figure, ink droplets are ejected from the liquid ejecting parts of the head 11 to form dots D1 to D4 on the printing paper.

First, when an array of the nozzles 18 of the head 11 lies on line (1), as shown in FIG. 7(*a*), ink droplets are ejected from the liquid ejecting parts (the first and fifth from the left) of the first liquid ejecting part group to form dots D1 on the printing paper. The liquid ejecting parts of the first liquid ejecting part group simultaneously eject ink droplets, and the ink droplets are ejected in the same direction from the liquid ejecting parts of the first liquid ejecting part group. That is, control is executed by the ejecting-direction control means so that the landing positions of ink droplets respectively ejected from the liquid ejecting parts of the liquid ejecting part group lie on a line parallel to the X-direction. FIG. 7(*a*) shows that dots D1 formed by the two liquid ejecting parts of the first liquid ejecting part group lie on line (1) parallel to the X-direction.

The liquid ejecting parts of the first liquid ejecting part group are controlled to eject ink droplets perpendicularly to the surface of the printing paper.

In the above description, the ejecting direction of an ink droplet can be made perpendicular to the surface of the printing paper (no deflection) by setting the voltage applied to the deflection-amplitude control terminal B at 0 V in the ejection control circuit 50. When ink droplets are ejected from the liquid ejecting parts of the first liquid ejecting part group in FIG. 7, the ejecting-direction control means executes control by setting B at 0 V so that the ink droplets are ejected perpendicularly to the surface of the printing paper.

When a predetermined time elapses after the dots D1 are formed by the liquid ejecting parts of the first liquid ejecting part group, ink droplets are ejected from the liquid ejecting parts of the second liquid ejecting part group to form dots D2, as shown in FIG. 7(*b*).

When the predetermined time elapses after formation of the dots D1 (when the dots D2 are formed), the printing paper is fed from line (1) shown in FIG. 7(*a*) to line (2) shown in FIG. 7(*b*). When the array of the nozzles 18 lies on line (1) in FIG. 7(*b*), ink droplets are ejected from the liquid ejecting parts of the second liquid ejecting part group to form dots D2. Under the control of the ejecting-direction control means, the liquid ejecting parts of the second liquid ejecting part group eject ink droplets in a direction different from the ejecting direction of the ink droplets ejected from the liquid ejecting parts of the first liquid ejecting part group.

As shown in FIG. 7(*b*), the array of the nozzles 18 lies on line (1) when ink droplets are ejected from the liquid ejecting parts of the second liquid ejecting part group. By setting the ejecting direction of ink droplets ejected from the liquid ejecting parts of the second liquid ejecting part group to be the same as the ejecting direction from the liquid ejecting parts of the above-described first liquid ejecting part group at this time, dots D2 are formed at circles shown by dotted lines in FIG. 7(*b*). In this case, the dots D2 are formed the predetermined time after formation of the dots D1, and consequently, the landing positions of the dots D2 are shifted in the Y-direction from the landing positions of the dots D1 by a distance corresponding to the feeding distance of the printing paper.

For this reason, the ejecting-direction control means executes control such as to eject ink droplets from the liquid ejecting parts of the second liquid ejecting part group at the ejecting angle different from the ejecting angle of the ink droplets from the liquid ejecting parts of the first liquid ejecting part group so that the ink droplets land on line (2) in FIG. 7(*b*) to form dots D2. The ejecting direction of the ink droplets from the liquid ejecting parts of the second liquid ejecting part group is controlled by setting the voltage applied to the deflection-amplitude control terminal B in the ejection control circuit 50 and turning the deflection control switches J1 to J3 ON/OFF, as described above.

All the liquid ejecting parts of the second liquid ejecting part group are controlled to eject ink droplets in the same ejecting direction. This allows all dots D2 formed by the liquid ejecting parts of the second liquid ejecting part group to lie on line (2) parallel to the X-direction.

Subsequently, when a predetermined time elapses after formation of the dots D2, ink droplets are ejected from the liquid ejecting parts of the third liquid ejecting part group to form dots D3, as shown in FIG. 7(*c*).

At the time when the dots D3 are formed, the printing paper is fed from line (1) in FIG. 7(*a*) to line (3) in FIG. 7(*c*), in a manner similar to the above. The array of the nozzles 18 is positioned on line (1) in FIG. 7(*c*).

In this case, when the dots D3 are formed by ejecting ink droplets from the liquid ejecting parts of the third liquid ejecting part group, control is also executed so that the dots D3 are formed on line (3) in FIG. 7(*c*), in a manner similar to that in FIG. 7(*b*). Therefore, the ejecting-direction control means executes control to eject ink droplets from the liquid ejecting parts of the third liquid ejecting part group at the ejecting angle different from the ejecting angle of the ink droplets from the liquid ejecting parts of the second liquid ejecting part group so that the ink droplets land on line (3) in FIG. 7(*c*) to form dots D3.

When the angle (angle corresponding to the angle θ in FIG. 5) formed by the ejecting direction of ink droplets from the liquid ejecting parts of the N-th liquid ejecting part group (N=1, 2, . . . ) with the direction perpendicular to the printing paper is represented by θ(N), the following condition is satisfied:

$\theta(1)=0$ (that is, direction perpendicular to the printing paper)

Moreover, θ(N) and θ(N+1) are in the following relationship:

$$\theta(N)<\theta(N+1)$$

Accordingly, when ink droplets are respectively ejected from the N-th liquid ejecting part and the (N+1)-th liquid ejecting part by the time-difference ejection means, the ejecting-direction control means executes control such that the angle θ(N+1) formed by the ejecting direction of the ink droplets from the (N+1)-th liquid ejecting part with the direction perpendicular to the printing paper is larger than the angle θ(N) formed by the ejecting direction of the ink droplets from the N-th liquid ejecting part with the printing paper.

In the above-described manner, as shown in FIG. 7(*d*), ink droplets are similarly ejected from the liquid ejecting parts of the fourth liquid ejecting part group to form dots D4 on line (4) in FIG. 7(*d*). One pixel line is printed in one cycle shown in FIGS. 7(*a*) to 7(*d*).

From the above, dots D1 to D4 can be arranged in one pixel line parallel to the X-direction even when ink droplets are ejected from a plurality of liquid ejecting parts at different times. Therefore, a smooth linear image having no serration can be printed.

When one cycle for ejecting ink droplets from the liquid ejecting parts of the first to fourth liquid ejecting part groups is completed, an operation of ejecting ink droplets from the liquid ejecting parts of the first liquid ejecting part group is performed again, as shown in FIG. 7(*e*). That is, ink droplets are ejected to form dots D1, in a manner similar to that shown in FIG. 7(*a*).

As is evident from FIG. 7, setting is made so that the printing paper moves only by one dot pitch when ejection from the liquid ejecting parts of the first liquid ejecting part group is performed again after one cycle for ejection from the first to fourth liquid ejecting part groups.

When operating the ejecting-direction control means, as described above, the ON/OFF states of the deflection control switches J1 to J3 corresponding to the N-th liquid ejecting part group are stored beforehand, and ON/OFF control of the deflection control switches J1 to J3 is executed according to the stored contents.

In this case, since the ejecting direction can be changed in eight stages by using three bits of signals from the deflection control switches J1 to J3 in the ejection control circuit 50, for example, it can be changed in four stages in the Z1-direction in FIG. 5, and in four stages in the Z2-direction.

Accordingly, the ejecting direction can be changed in three stages, as shown in FIG. 7, by using three of the four stages in one of the directions. In this case, the voltage applied to the deflection-amplitude control terminal B is set, for example, so that ink droplets can land on line (2) from the array of the nozzles 18 placed on line (1) in FIG. 7(*b*) by changing the ejecting direction in one stage.

Second Embodiment

Figure 8:
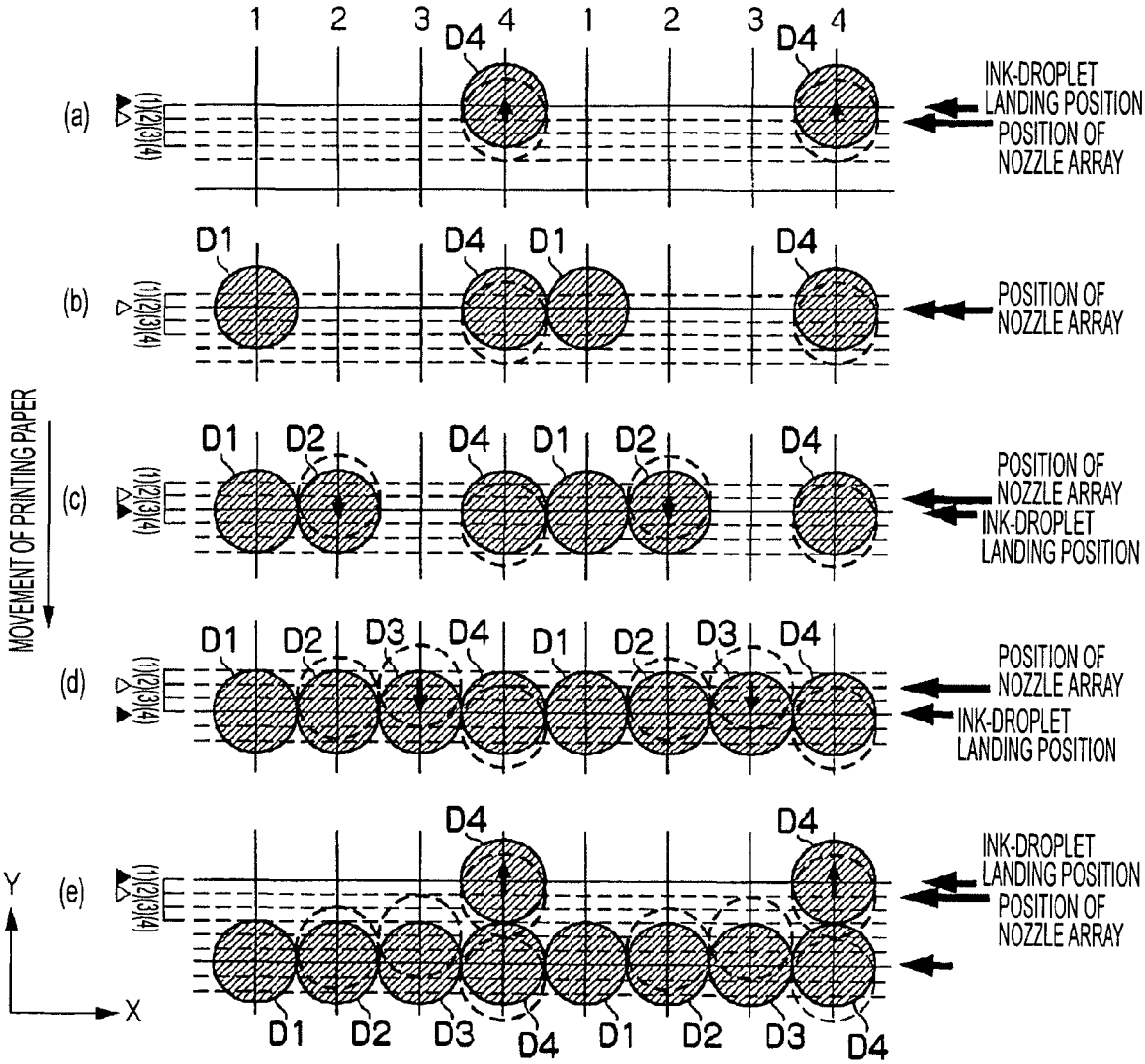
FIG. 8 is a plan view explaining the control of ejection of ink droplets executed by a time-difference ejection means and an ejecting-direction control means (second embodiment).
Figure 11:
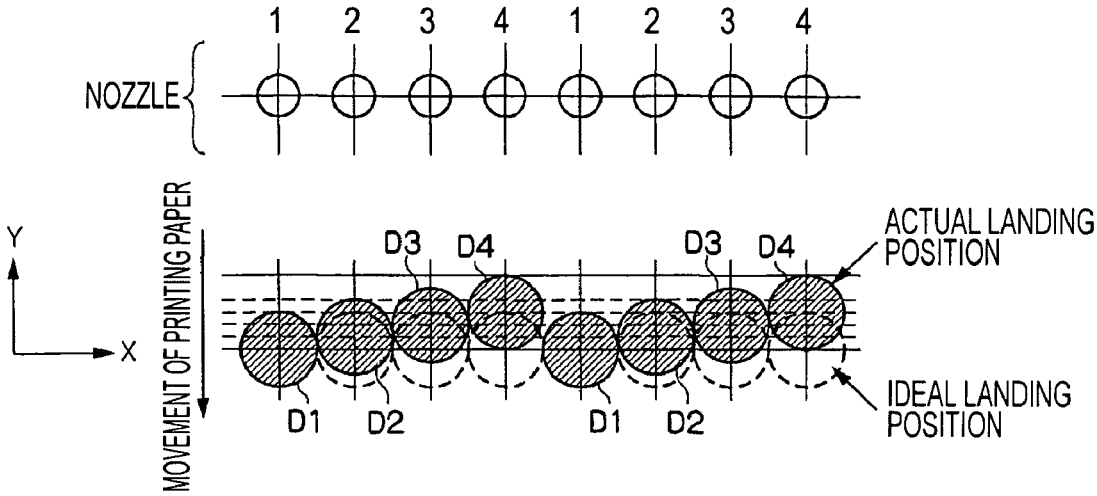
FIG. 11 is a view showing the positional relationship between the arrangement of nozzles in a liquid ejecting part and dots formed on printing paper.
Figure 12:
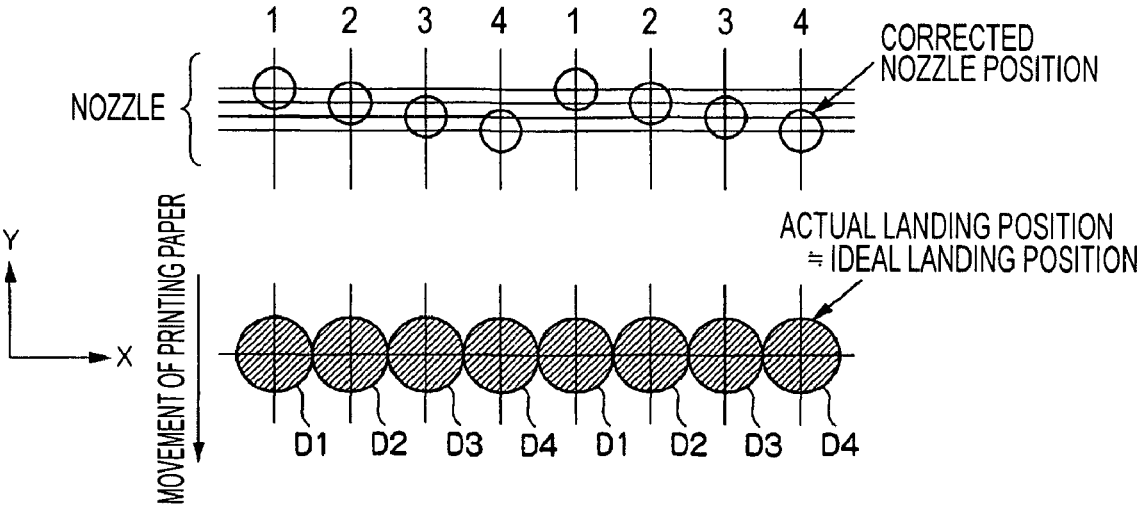
FIG. 12 is a view showing an example in which nozzles of liquid ejecting parts that perform ejection with a time difference are not aligned with one another in the Y-direction.

FIG. 8 is a plan view explaining control of the ejection of ink droplets by a time-difference ejection means and an ejecting-direction control means in a second embodiment of the present invention.

In the second embodiment shown in FIG. 8, similarly to the first embodiment shown in FIG. 7, liquid ejecting parts of first to fourth liquid ejecting part groups are arranged, and two liquid ejecting parts are provided for each of the liquid ejecting part groups. In the second embodiment shown in FIG. 8, control is executed so that ink droplets are ejected from the fourth liquid ejecting part group, the first liquid ejecting part group, the second liquid ejecting part group, and the third liquid ejecting part group in that order.

In the second embodiment shown in FIG. 8, the ejecting directions (ejecting angles) of ink droplets ejected from the liquid ejecting parts of the first to fourth liquid ejecting part groups are different from those in the first embodiment shown in FIG. 7.

In FIG. 7, the ejecting angle θ(N) of ink droplets ejected from the liquid ejecting parts of the N-th liquid ejecting part group satisfies the following condition:

$$\theta(1)=0 \text{ and } \theta(N)<\theta(N+1)$$

In contrast, in FIG. 8, the following condition is set:

$$\theta(1)=0,\ \theta(2)<\theta(3),\ \theta(4)=-\theta(2)$$

That is, when an array of nozzles 18 lies on line (2), as shown in FIG. 8(*a*), ink droplets are first ejected from the liquid ejecting parts of the fourth liquid ejecting part group so as to land on line (1). Dots D4 are thereby formed on line (1).

In this case, the ejecting directions of the ink droplets is symmetrical with respect to the ejecting direction of ink droplets from the liquid ejecting parts of the second liquid ejecting part group in FIG. 7(*b*) (the angle with respect to the direction perpendicular to printing paper is the same).

Next, ink droplets are ejected from the liquid ejecting parts of the first liquid ejecting part group when a predetermined time elapses after ejection of the ink droplets from the liquid ejecting parts of the fourth liquid ejecting part group. After the predetermined elapses, line (2) on which the dots D4 are formed lies directly below the array of the nozzles 18, as shown in FIG. 8(*b*). Therefore, when the ink droplets are ejected from the liquid ejecting parts of the first liquid ejecting part group, they are ejected in the same direction as the ejecting direction of the ink droplets from the liquid ejecting parts of the first liquid ejecting part group in FIG. 7(*a*), that is, perpendicularly to the printing paper. Dots D1 are thereby formed on line (2) on which the dots D4 are provided, as shown in FIG. 8(*b*).

Subsequently, ejection of ink droplets from the liquid ejecting parts of the second liquid ejecting part group (FIG. 8(*c*)) and ejection of ink droplets from the liquid ejecting parts of the third liquid ejecting part group (FIG. 8(*d*)) are performed in a manner similar to those shown in FIGS. 7(*b*) and 7(*c*). That is, the ejecting direction of the ink droplets from the liquid ejecting parts of the second liquid ejecting part group is the same as the ejecting direction of the ink droplets from the liquid ejecting parts of the second liquid ejecting part group in FIG. 7(*b*) (or is symmetrical with respect to the ejecting direction of the ink droplets from the liquid ejecting parts of the fourth liquid ejecting part group in FIG. 8(*a*)). The ejecting direction of the ink droplets from the liquid ejecting parts of the third liquid ejecting part group is the same as the ejecting direction of the ink droplets from the liquid ejecting parts of the third liquid ejecting part group shown in FIG. 7(*c*).

In the embodiment shown in FIG. 7, the ejecting angle with respect to the ejecting direction (direction perpendicular to the surface of the printing paper) of the ink droplets from the liquid ejecting parts of the first liquid ejecting part group, which first performs ejection, sequentially increases during the operation of the time-difference ejection means. In the embodiment shown in FIG. 8, the ejecting direction (direction perpendicular to the surface of the printing paper) of the ink droplets from the liquid ejecting parts of the first liquid ejecting part group, which performs ejection second, serves as the reference.

Control may be executed in any of the manners shown in FIGS. 7 and 8. For example, when the ejecting direction of the ink droplets from the liquid ejecting parts of the liquid ejecting part group near the center in one cycle is set to be perpendicular to the surface of the printing paper during operation of the time-difference ejection means, as shown in FIG. 8, the maximum ejecting angle (angle θ in FIG. 5) relative to the direction perpendicular to the surface of the printing paper can be set small.

Third Embodiment

A third embodiment of the present invention will next be described.

FIG. 9 includes a plan view and a right side sectional view showing the arrangement of heating resistors 13 in a head of the third embodiment in more detail, correspondingly to FIG. 3 showing the first embodiment.

A head of the third embodiment includes heating resistors 13 arranged in the Y-direction, as in the first embodiment, and heating resistors 13 arranged in the X-direction thereunder.

Two heating resistors 13 arranged in the Y-direction are controlled in a manner similar to that in the first embodiment. In the third embodiment, two heating resistors 13 arranged in the X-direction are controlled by an ejection control circuit 50 that is similar to that in the first embodiment and is separate from an ejection control circuit 50 to which the two heating resistors 13 arranged in the Y-direction are connected.

Consequently, an ejecting-direction changing means can change the ejecting direction of an ink droplet from a nozzle 18 to a plurality of different directions along both the X- and Y-directions.

By changing the ejecting direction of the ink droplet to a plurality of different directions along the Y-direction, the landing position of the ink droplet is controlled by using a time-difference ejection means and an ejecting-direction control means, in a manner similar to that in the first or second embodiment.

Moreover, by changing the ejecting direction of the ink droplet to a plurality of different directions along the X-direction, the landing position of the ink droplet in the X-direction is corrected by using the ejecting-direction control means.

For example, when there is no variation in ejection characteristic, such as ejecting direction in the X-direction, among liquid ejecting parts in one head, dots D1 to D4 are arrayed in the X-direction at regular intervals on one pixel line, as shown in FIG. 7(*d*).

In contrast, in a case in which there are variations in ejection characteristic, such as ejecting direction in the X-direction, among the liquid ejecting parts, for example, when the second dot D2 from the left in FIG. 7(*d*) is displaced to the left in the X-direction in the figure, it is disposed closer to the leftmost dot D1 and away from the third dot D3 from the left.

When this state continues, an overlapping portion between the leftmost dot D1 and the second dot D2 from the left is successively formed in the feeding direction of printing paper, and a band is produced in the Y-direction and is sometimes conspicuous. On the other hand, a space between the second dot D2 and the third dot D3 from the left is successively formed in the feeding direction of the printing paper, and a white band is produced in the Y-direction and is sometimes conspicuous.

In order to avoid this situation, the landing position of the ink droplet is also corrected in the X-direction.

In this case, for example, a test pattern is printed by ejecting ink droplets from all liquid ejecting parts without correcting the ejecting directions of the ink droplets in the X-direction, and the print result is read by an image reading apparatus such as an image scanner. On the basis of the read result, it is detected whether any of the liquid ejecting parts ejects an ink droplet that lands on a position displaced by an amount above a predetermined value with respect to the other liquid ejecting parts. When a liquid ejecting part that causes the displacement of the landing position above the predetermined value is detected, the degree of displacement is further detected. According to the detection result, deflection control switches J1 to J3 of the ejection control circuit 50, to which the two heating resistors 13 arranged in the X-direction are connected, are subjected to ON/OFF control to correct the ejecting direction of the ink droplet from the subject liquid ejecting part so that the dot pitch in the X-direction is substantially fixed.

Furthermore, ON/OFF states of the deflection control switches J1 to J3 in each liquid ejecting part (in the X-direction) are stored beforehand. For example, the stored contents are read when the printer is powered on, and the ON/OFF states of the deflection control switches J1 to J3 in each liquid ejecting part (in the X-direction) are set.

Fourth Embodiment

FIG. 10 includes a plan view and a right side sectional view showing the arrangement of heating resistors 13 in a head according to a fourth embodiment in more detail, correspondingly to FIG. 3 for the first embodiment.

As shown in FIG. 10, the head of the fourth embodiment includes four heating resistors 13A to 13D.

The heating resistors 13A and 13C, and the heating resistors 13B and 13D are arranged in the Y-direction. The heating resistors 13A and 13B, and the heating resistors 13C and 13D are arranged in the X-direction.

The heating resistors 13A and 13C are connected to a circuit similar to the ejection control circuit 50 in the first or second embodiment. That is, in FIG. 6, the resistor Rh-A corresponds to the heating resistor 13A, and the resistor Rh-B corresponds to the heating resistor 13C (hereinafter, the ejection control circuit will be referred to as an ejection control circuit 50X).

The heating resistors 13B and 13D are connected to a circuit similar to the ejection control circuit 50 in the first or second embodiment, similarly to the above. That is, in FIG. 6, the resistor Rh-A corresponds to the heating resistor 13B, and the resistor Rh-B corresponds to the heating resistor 13D (hereinafter, the ejection control circuit will be referred to as an ejection control circuit 50Y).

Control is executed so that switches of the ejection control circuits 50X and 50Y are placed in the same ON/OFF state when the landing position of an ink droplet in the X-direction is not corrected.

Thereby, the same current flows through the heating resistors 13A and 13B. Similarly, the same current flows through the heating resistors 13C and 13D.

When the same current flows through all the heating resistors 13A to 13D, an ink droplet is ejected perpendicularly to the surface of printing paper. In contrast, for example, when the current flowing through the heating resistors 13A and 13B is smaller than the current flowing through the heating resistors 13C and 13D, an ink droplet is ejected while being deflected in the Y-direction (positive direction) in FIG. 10.

This control allows a time-difference ejection means and an ejecting-direction control means to be operated, in a manner similar to that in the first or second embodiment.

In order to correct the landing position of an ink droplet in the X-direction, as in the third embodiment, control is executed so that the switches of the ejection control circuits 50X and 50Y are placed in different ON/OFF states.

For example, when the current flowing through the heating resistor 13A (or 13C) is smaller than the current flowing through the heating resistor 13B (or 13D), an ink droplet is ejected while being deflected in the X-direction (positive direction) in FIG. 10.

This control allows the landing position of the ink droplet to be controlled in both the Y- and X-directions, in a manner similar to that in the third embodiment.

While one embodiment of the present invention has been described above, the present invention is not limited to the above embodiment, and for example, various modifications are possible as follows:

(1) While four liquid ejecting part groups are provided to eject ink droplets in one pixel line in FIGS. 7 and 8, any number of liquid ejecting part groups may be provided. Liquid ejecting parts that belong to one liquid ejecting part group may be placed at any positions as long as at least they do not adjoin one another. Furthermore, any number of liquid ejecting parts may belong to one liquid ejecting part group.

(2) During operation of the time-difference ejection means and the ejecting-direction control means, ink droplets may be ejected in any direction from the liquid ejecting parts of the N-th liquid ejecting part group. For example, the ejecting directions from the liquid ejecting parts of the first to fourth liquid ejecting part groups in FIG. 7 may be exactly reversed. That is, the ejecting direction from the liquid ejecting parts of the first liquid ejecting part group may be symmetrical with that of the liquid ejecting parts of the fourth liquid ejecting part group in FIG. 7, the ejecting direction from the liquid ejecting parts of the second liquid ejecting part group may be symmetrical with that of the liquid ejecting parts of the third liquid ejecting part group in FIG. 7, the ejecting direction from the liquid ejecting parts of the third liquid ejecting part group may be symmetrical with that of the liquid ejecting parts of the second liquid ejecting part group in FIG. 7, and the ejecting direction from the liquid ejecting parts of the fourth liquid ejecting part group may coincide with that of the liquid ejecting parts of the first liquid ejecting part group in FIG. 7.

(3) In this embodiment, all dots caused to land by the time-difference ejection means are arrayed on a line parallel to the array of the nozzles 18. However, the dots may land near the line parallel to the array of the nozzles 18, and it is not always necessary that all dots should be exactly placed on the line parallel to the array of the nozzles 18. That is, the effect of the ejecting-direction control means can be expected by executing control such that the distance in the Y-direction between two dots formed by using the time-difference ejection means is shorter than the distance for which the printing paper moves from when the first dot is formed to when the next dot is formed.

(4) While the line head 10 is given as an example in the above embodiments, the present invention is also applicable to a serial type.

In the serial type, one head 11 is disposed so that nozzles 18 are arrayed in the Y-direction. Ink droplets are applied onto printing paper while moving the head 11 in the X-direction. When printing in the X-direction is completed by performing the above operation once or a plurality of times, the printing paper is fed in the Y-direction, and the next operation of printing in the X-direction is performed.

In the case of the serial type, when the time-difference ejection means is used during movement of the head 11 in the X-direction, dots can also be arrayed on a line parallel to the Y-direction by controlling the landing positions of ink droplets in the X-direction by the ejecting-direction control means.

(5) While three bits of control signals of J1 to J3 are used in the ejection control circuit 50 shown in FIG. 6, the number of bits is not limited. Any number of bits of control signals may be used.

(6) In this embodiment, a difference is made between the periods of time taken for ink droplets to boil on the two heating resistors 13 juxtaposed in the Y- or X-direction (bubble generation times) by passing different currents through the heating resistors 13. Alternatively, two heating resistors 13 having the same resistance may be arranged in the Y- or X-direction, and the current may be applied thereto at different times. For example, when independent switches are respectively provided for two heating resistors 13 and the switches are turned on at different times, a difference can be made between the times at which bubbles are generated in ink on the heating resistors 13. Furthermore, changing of the currents flowing through the heating resistors 13 and making the difference between the current application times may be performed in combination.

(7) In this embodiment, two heating resistors 13 are juxtaposed in the Y-direction or the X-direction in one ink chamber 12. This is because it is sufficiently verified that two heating resistors ensure durability and the circuit configuration can be simplified. However, three or more heating resistors 13 may be arranged in one ink chamber 12.

(8) While the heating resistors 13 are given as examples of the bubble generating means in this embodiment, heating elements other than resistors may be used. Not only the heating elements, but also energy generating elements of other types may be used. For example, electrostatic ejection or piezoelectric energy generating elements may be used.

An electrostatic ejection energy generating element includes a vibration plate, and two electrodes provided under the vibration plate with an air layer disposed therebetween. The vibration plate is bent downward by applying a voltage between the electrodes, and an electrostatic force is then released by making the voltage 0 V. In this case, an ink droplet is ejected by using elastic force produced when the vibration plate returns to its original state.

In this case, in order to form a difference between energies produced by the energy generating elements, for example, a time difference is made between the two energy generating elements or different voltages are applied to the two energy generating elements when the vibration plate is returned to its original state (electrostatic force is released by making the voltage 0 V).

A piezoelectric energy generating element includes a laminate composed of a piezoelectric element having electrodes on both sides, and a vibration plate. When a voltage is applied to the electrodes on both sides of the piezoelectric element, a bending moment is produced in the vibration plate by a piezoelectric effect, and the vibration plate bends and deforms. An ink droplet is ejected by utilizing the deformation.

In this case, similarly to the above, in order to form a difference between energies produced by the energy generating elements, for example, a voltage is applied to the electrodes on both sides of the two piezoelectric elements with a time difference, or different voltages are applied to the two piezoelectric elements.

(9) While the head 11 is applied to the printer as an example in the above embodiments, the present invention is applicable not only to the printer, but also to various liquid ejecting apparatuses. For example, the present invention is applicable to an apparatus that ejects a DNA-containing solution for detection of a biological specimen in the form of a droplet so that the droplet lands on a droplet landing object.

According to the present invention, in the head including the nozzles arrayed in line, even when ink droplets are ejected from a plurality of liquid ejecting parts at different times, it is possible to reduce displacement of the landing positions of the droplets based on the relative moving distance between the head and the droplet landing object.

The invention claimed is:

1. A liquid ejecting apparatus comprising a head including a plurality of liquid ejecting parts juxtaposed to array nozzles in line, wherein each of the liquid ejecting parts includes:

a liquid chamber containing liquid to be ejected;

bubble generating means provided in the liquid chamber to generate a bubble in the liquid inside the liquid chamber by the supply of energy; and nozzle forming member that forms the nozzles for ejecting the liquid in the liquid chamber in response to the generation of the bubble by the bubble generating means, wherein the liquid ejecting apparatus applies droplets ejected from the nozzles in the liquid ejecting parts onto a droplet landing object that moves relative to the head in a direction perpendicular to the array direction of the nozzles, wherein the bubble generating means includes a plurality of bubble generating means juxtaposed in the liquid chamber at least in the direction perpendicular to the array direction of the nozzles, and wherein the liquid ejecting apparatus further comprises:

ejecting-direction changing means for changing the ejecting direction of the droplets ejected from the nozzles to a plurality of different directions along the direction perpendicular to the array direction of the nozzles by supplying the energy to at least one and at least another one of the plurality of bubble generating means, which are juxtaposed in the direction perpendicular to the array direction of the nozzles in the liquid chamber, in different manners;

time-difference ejection means for controlling ejection of droplets from a first liquid ejecting part, of the plurality of liquid ejecting parts, and a second liquid ejecting part different from the first liquid ejecting part so that a droplet is ejected from the second liquid ejecting part when a predetermined time elapses after a droplet is ejected from the first liquid ejecting part; and ejecting-direction control means for controlling the ejection of the droplets from the first liquid ejecting part and the second liquid ejecting part by the time-difference ejection means so that the ejecting direction of the droplet ejected from the first liquid ejecting part and the ejecting direction of the droplet ejected from the second ejecting part are made different by using the ejecting-direction changing means, and so that the distance between the landing position of the droplet ejected from the first liquid ejecting part and the landing position of the droplet ejected from the second liquid ejecting part in the direction perpendicular to the array direction of the nozzles is shorter than a relative moving distance for which the head and the droplet landing object relatively move from when the droplet ejected from the first liquid ejecting part lands to when the droplet ejected from the second liquid ejecting part lands.

2. The liquid ejecting apparatus according to claim 1, wherein the ejecting-direction control means executes control such that, when the droplets are ejected from the first liquid ejecting part and the second ejecting part by the time-difference ejection means, the angle formed by the ejecting direction of the droplet ejected from the second liquid ejecting part with a direction perpendicular to the droplet landing object is larger than the angle formed by the ejecting direction of the droplet ejected from the first liquid ejecting part with the direction perpendicular to the droplet landing object.

3. The liquid ejecting apparatus according to claim 1, wherein the ejecting-direction control means executes control such that, when the droplets are ejected from the first liquid ejecting part and the second ejecting part by the time-difference ejection means, the angle formed by the ejecting direction of the droplet ejected from the second liquid ejecting part with a direction perpendicular to the droplet landing object is smaller than the angle formed by the ejecting direction of the droplet ejected from the first liquid ejecting part with the direction perpendicular to the droplet landing object.

4. The liquid ejecting apparatus according to claim 1, wherein the ejecting-direction control means executes control such that, when the droplets are ejected from the first liquid ejecting part and the second ejecting part by the time-difference ejection means, the landing position of the droplet ejected from the first ejecting part and the landing position of the droplet ejected from the second ejecting part are placed on a ling parallel to the array direction of the nozzles.

5. The liquid ejecting apparatus according to claim 1, wherein, when droplets are ejected from a plurality of liquid ejecting parts of a first liquid ejecting part group that are not adjacent to each other, and a plurality of liquid ejecting parts of a second liquid ejecting part group that are not adjacent to each other and do not belong to the first liquid ejecting part group, the time-difference ejection means executes control such that the droplets are ejected from the liquid ejecting parts of the second liquid ejecting part group when a predetermined time elapses after the droplets are ejected from the liquid ejecting parts of the first liquid ejecting part group, wherein, when the droplets are ejected from the liquid ejecting parts of the first liquid ejecting part group and the second liquid ejecting part group by the time-difference ejection means, the ejecting-direction control means executes control such that the droplets are ejected from the liquid ejecting parts of the first liquid ejecting part group in a fixed direction to place the landing positions of the droplets ejected from the liquid ejecting parts of the first liquid ejecting part group on a first line parallel to the array direction of the nozzles, and such that that the droplets are ejected from the liquid ejecting parts of the second liquid ejecting part group in a fixed direction to place the landing positions of the droplets ejected from the liquid ejecting parts of the second liquid ejecting part group on a second line parallel to the array direction of the nozzles, and wherein the ejecting-direction control means executes control such that the ejecting direction of the droplets ejected from the liquid ejecting parts of the first liquid ejecting part group and the ejecting direction of the droplets ejected from the liquid ejecting parts of the second liquid ejecting part group are made different by the ejecting-direction changing means, and such that the distance between the first line and the second line in the direction perpendicular to the array direction of the nozzles is shorter than a relative moving distance for which the head and the droplet landing object move relative to each other from when the droplets ejected from the liquid ejecting parts of the first liquid ejecting part group land to when the droplets ejected from the liquid ejecting parts of the second liquid ejecting part group land.

6. The liquid ejecting apparatus according to claim 1, wherein the head includes a plurality of heads arranged and connected in the juxtaposing direction of the liquid ejecting parts so as to form a line head.

7. The liquid ejecting apparatus according to claim 1, wherein the bubble generating means includes a plurality of bubble generating means juxtaposed in the array direction of the nozzles in the liquid chamber, and wherein, when the energy is supplied to the plurality of bubble generating means juxtaposed in the array direction of the nozzles in the liquid chamber, the ejecting-direction changing means changes the ejecting direction of the droplets ejected from the nozzles to a plurality of different directions along the array direction of the nozzles by applying the energy to at least one and at least another one of the bubble generating means in different manners.

8. A liquid ejecting method which applies droplets ejected from nozzles of a plurality of liquid ejecting parts provided in a head onto a droplet landing object that moves relative to the head in a direction perpendicular to the array direction of the nozzles, the liquid ejecting parts being juxtaposed to array the nozzles in line, wherein the ejecting direction of the droplets ejected from the nozzles is variable to a plurality of different directions along the direction perpendicular to the array direction of the nozzles, wherein control is executed so that, when droplets are ejected from a first liquid ejecting part and a second liquid ejecting part different from the first liquid ejecting part, of the plurality of liquid ejecting parts, a droplet is ejected from the second liquid ejecting part when a predetermined time elapses after a droplet is ejected from the first liquid ejecting part, and wherein, control is executed so that, when the droplets are ejected from the first liquid ejecting part and the second liquid ejecting part, the ejecting direction of the droplet ejected from the first liquid ejecting part is different from the ejecting direction of the droplet ejected from the second liquid ejecting part, and so that the distance between the landing position of the droplet ejected from the first ejecting part and the landing position of the droplet ejected from the second ejecting part in the direction perpendicular to the array direction of the nozzles is shorter than a relative moving distance for which the head and the droplet landing object relatively move from when the droplet ejected from the first liquid ejecting part lands to when the droplet ejected from the second liquid ejecting part lands.

* * * * *